US009168407B2

(12) United States Patent
Kho et al.

(10) Patent No.: US 9,168,407 B2
(45) Date of Patent: Oct. 27, 2015

(54) CALIBRATION MODULE AND REMOTE TEST SEQUENCE UNIT

(71) Applicant: Ametek Ameron, LLC, Baldwin Park, CA (US)

(72) Inventors: Edwin R. Kho, Garden Grove, CA (US); Abdul N. Sitabkhan, Arcadia, CA (US); Souvanh Bounpraseuth, Ontario (CA); Ramy S. Ghebrial, Rancho Cucamonga (CA)

(73) Assignee: Ametek Ameron, LLC, Baldwin Park, CA (US)

( * ) Notice: Subject to any disclaimer, the term of this patent is extended or adjusted under 35 U.S.C. 154(b) by 302 days.

(21) Appl. No.: 14/015,701

(22) Filed: Aug. 30, 2013

(65) Prior Publication Data

US 2015/0060092 A1 Mar. 5, 2015

(51) Int. Cl.

| | |
|---|---|
| ***A62C 2/00*** | (2006.01) |
| ***A62C 37/50*** | (2006.01) |
| ***A62C 99/00*** | (2010.01) |
| ***A62C 37/10*** | (2006.01) |
| ***A62C 3/08*** | (2006.01) |
| ***A62C 35/58*** | (2006.01) |
| ***A62C 3/02*** | (2006.01) |
| ***B05B 7/08*** | (2006.01) |
| ***B05B 12/00*** | (2006.01) |

(52) U.S. Cl.

CPC ..... *A62C 37/50* (2013.01); *A62C 3/0207* (2013.01); *A62C 3/08* (2013.01); *A62C 35/58* (2013.01); *A62C 37/10* (2013.01); *A62C 99/009* (2013.01); *A62C 99/0018* (2013.01); *B05B 7/0815* (2013.01); *B05B 12/00* (2013.01)

(58) Field of Classification Search

CPC .. A62C 99/009; A62C 99/0018; A62C 37/10; A62C 37/50; A62C 3/08; A62C 3/0207; B05B 7/0815; B05B 12/00

USPC ..... 169/11, 16, 23, 43, 61, 62; 244/129.2

See application file for complete search history.

(56) References Cited

U.S. PATENT DOCUMENTS

| | | | | |
|---|---|---|---|---|
| 3,428,130 A * | 2/1969 | Rockwell | A62C 99/009 169/23 |
| 4,351,394 A * | 9/1982 | Enk | A62C 3/08 169/16 |
| 4,369,647 A | 1/1983 | Shigemori et al. | |
| 4,482,018 A * | 11/1984 | Enk et al. | A62C 3/08 169/62 |

(Continued)

FOREIGN PATENT DOCUMENTS

WO WO 2010/121222 10/2010

*Primary Examiner* — Steven J Ganey

(57) ABSTRACT

A calibration and verification system and method for dynamically controlling sequential delivery of mixtures containing a fire suppression agent to detection locations to simulate an agent discharge during a flight operation of an aircraft and for allowing direct monitoring of the concentration amounts at the detection locations to adjust a testing operation accordingly. Each of the mixtures is prepared with a precise concentration amount of the agent. The system and method include a remote test sequence unit for determining an optimal testing time period during a flight operation to remotely control the discharge and monitoring of the agent. Prior to the optimal testing time period, an airflow at an altitude of the flight operation is drawn through each of a plurality of detectors to tare out the characteristics of a surrounding environment using a processor, thereby establishing a measurement baseline for each of the plurality of detectors.

20 Claims, 15 Drawing Sheets

(56) References Cited

U.S. PATENT DOCUMENTS 4,726,426 A * 2/1988 Miller ..... A62C 99/0018 169/16
5,038,867 A * 8/1991 Hindrichs ..... A62C 35/58 169/62
5,265,459 A 11/1993 Cohen
6,676,081 B2 1/2004 Grabow et al.
9,033,061 B2 * 5/2015 Chattaway ..... A62C 37/44 169/11
2003/0039299 A1 2/2003 Horovitz et al.
2005/0183869 A1 8/2005 Lazaarini

* cited by examiner

| | | |
|---|---|---|
| Weight – Empty (Vacuum) Calibration Bottle | _____ | grams - 202 |
| Weight – Empty (Vacuum) Calibration Bottle With Charging Fixture Attached | _____ | grams - 204 |
| Pressure Reading of Agent only | _____ | psig - 206 |
| Weight – Calibration Bottle with Agent | _____ | grams - 208 |
| Weight of Agent (Line 208 - 202) | _____ | grams - 210 |
| Weight of Nitrogen Gas Required (Line 210 / [Agent: N2 mass ratio]) | _____ | grams - 212 |
| Pressure Reading of Calibration Bottle | _____ | psig - 214 |
| Weight – Calibration Bottle With Agent and Nitrogen Gas | _____ | grams - 216 |
| Weight of Nitrogen Gas (Line 216 –Line 208) | _____ | grams - 218 |
| Concentration of Agent In Calibration Bottle | _____ | % - 220 |

FIG. 6B

| 702 SEC | 704 MIN | 706 EVENT | 708 LIGHT SEQUENCE | 710 DET1 LED | 712 DET 2 LED |
|---|---|---|---|---|---|
| 0 | 0.000 | RUN SEQ - ON | START - ON | ON – BUNK 1X | ON – BUNK 1X |
| 24 | 0.400 | RUN SEQ - OFF | START - OFF | | |
| 30 | 0.500 | PUMP - ON | STANDBY - ON | NOTICE – BUNK 1X | NOTICE – BUNK 1X |
| 60 | 1.000 | - | | NOTICE – BUNK 1X | NOTICE – BUNK 1X |
| 90 | 1.500 | - | | NOTICE – BUNK 1X | NOTICE – BUNK 1X |
| 120 | 2.000 | - | | NOTICE – BUNK 1X | NOTICE – BUNK 1X |
| 144 | 2.400 | - | STANDBY-BUNK 3X | | |
| 150 | 2.500 | FIRE BOTTLE WIDOW-START | FIRE - ON | NOTICE – BUNK 1X | NOTICE – BUNK 1X |
| 180 | 3.000 | - | | NOTICE – BUNK 1X | NOTICE – BUNK 1X |
| 204 | 3.400 | FIRE BOTTLE WINDOW-END | FIRE – OFF. BUNK 3X | | |
| 210 | 3.500 | - | STANDBY - ON | NOTICE – BUNK 1X | NOTICE – BUNK 1X |
| 240 | 4.000 | - | | NOTICE – BUNK 1X | NOTICE – BUNK 1X |
| 264 | 4.400 | PUMP - OFF | | NOTICE – BUNK 1X | NOTICE – BUNK 1X |
| 270 | 4.500 | RUN SEQ - OFF | STANDBY – OFF.BUNK 3X | OFF – BUNK 1X | OFF – BUNK 1X |

FIG. 14

CALIBRATION MODULE AND REMOTE TEST SEQUENCE UNIT

BACKGROUND OF THE INVENTION

1. Field of the Invention

The present invention calibrates a fire extinguisher monitoring system, dynamically controls, adjusts and measures the flow and distribution of a fire suppression agent, determines an optimal testing time period during a flight operation, and provides direct read-out of concentration amounts in substantially real time.

2. Description of Related Art

The Federal Aviation Agency (FAA) has required the use of fire suppression equipment in at least engines, auxiliary power units and cargo holds of aircrafts. A number of different fire suppression agents are available for discharge including but not limited to Halon 1301, Halon 1211, HFC-125, NOVEC 1230 and FM 200. The present invention is directed to addressing at least the following deficiencies and needs in the art:

Current available equipment in the field is capable of utilizing only 100% gas concentration for calibration in the field. There is a need in the art to calibrate a fire extinguisher monitoring system and verify a plurality of concentration amounts at a plurality of detection locations, respectively, using critical and precise concentration amounts or moles of the fire suppression agent (e.g., concentration amounts of 6%-18%) at a test site on the ground and/or during a flight operation before the fire suppression agent is discharged. Throughout the application herein, references to a "test site on the ground" or the like is not limited to a testing facility, and they may refer to any testing location (e.g., any airport) in which an aircraft and/or a fire extinguisher monitoring system may be stationed. As such, more particularly, there is a need in the art to perform the preceding calibration and verification using a calibration module capable of operating in a variety of testing sites on the ground and/or during on-flight testing.

There is yet a further need in the art to take into consideration and tare out characteristics of a surrounding environment (e.g., an airflow) at a test site on the ground or during on-flight testing given that the surrounding environment varies from a first testing operation to another, thereby causing inconsistencies and inaccuracies in the testing operations. As such, more specifically, there is yet a further need in the art to determine a measurement baseline for each of a plurality of detectors utilized to monitor the fire suppression agent discharge.

There is yet a further need to coordinate discharges of a fire suppression agent and monitoring its concentration at a plurality of detection locations with a flight operation during on-flight testing, and determine an optimal testing time period for discharging and monitoring the fire suppression agent.

There is yet a further need in the art to provide a direct read-out of the plurality of concentration amounts in substantially real time to allow dynamic adjustment of testing on the ground or during a flight operation.

There is yet a further need in the art to remotely control (e.g., from the ground) a discharge of a fire suppression agent and monitoring its concentration amount at a plurality of detection locations in a flying pilotless aircraft.

SUMMARY OF THE INVENTION

The present invention provides a salutation for each of the preceding needs in the art as follows:

(a) The present invention is in part directed to a calibration module configured to calibrate a plurality of detectors and verify a plurality of concentration amounts over time at a plurality of detection locations, respectively. In one embodiment, the calibration module determines whether each of the plurality of concentration amounts at the plurality of detections locations, respectively, is maintained at a minimum concentration amount (for example, 6% for Halon 1301 and 17.6% for HFC-125) for at least a minimum time period (e.g., 0.5 seconds). The verification can be further used to certify the fire extinguisher monitoring system. The calibration module may be utilized at a variety of testing sites on the ground and/or during a flight operation.

To perform the testing operations using precise concentration amounts of the fire suppression agent, the present invention is further directed to preparing a plurality of mixtures with critical and precise concentration amounts or moles a fire suppression agent (e.g., 6%-18%) at the test site on the ground and/or on the flight before the fire suppression agent is discharged. Unlike the devices in the art directed to testing operations using 100% concentration agents, the calibration module has the unique advantage of delivering various precise concentration levels of, for example, ranging from 6% to 18% for accurately and dynamically simulating a discharge of the fire suppression agent surrounded by an airflow at an altitude during a flight operation. A key element in operating the calibration module is providing the exact mixtures of the fire suppression agent mixed with an airflow-simulating fluid (e.g., Nitrogen or air) or other fluids. This is accomplished by determining and introducing precise moles of gas or gases into a high-pressure calibration container that is then used to fill a closed-loop container (e.g., an inflatable) bag of a calibration module.

(b) The present invention is further directed to taring out ambient air characteristics at the test site on the ground and taring out airflow characteristics at an altitude of a flight operation in order to determine a measurement baseline for each of a plurality of detectors utilized to monitor the fire suppression agent discharge. As such, an advantageous feature of the present invention is that extraneous factors such as altitude of the aircraft, humidity present at the dynamic flow characteristics and large temperature variations depending on the aircraft's flight path and weather characteristics do not considerably affect the precision of the testing, measurements, and generation of concentration data.

Furthermore, every detector has peculiar responses to fire suppression agent regardless of the degree of manufacturing precision and uniformity. A detector as referred to throughout the application, refers to any device or sensor that senses, detects, or measures a physical property and produces an output based on the sensed, detected or measured property. Prior to sampling the discharged fire suppression gases, a vacuum source or pump is used to draw the existing airflow at the altitude in which testing is being conducted through each of the plurality of detectors. A processor negates the effect of the surrounding environment characteristics (e.g., humidity, altitude effects and temperature) on each of the plurality of detectors. As such, the present invention takes into account and negates particular characteristics and responses of each of the plurality of detectors at the altitude of testing in order to precisely measure the concentration amounts. Because the characteristics are tared out on the ground and at an altitude of a flight operation, the precision of testing is significantly enhanced, rendering the monitoring of the concentration amounts immune to inaccuracies due to external characteristics of the surrounding environment.

(c) The present invention is further directed to a remote test sequence unit for determining an optimal testing time period during a flight operation of an aircraft to discharge a fire suppression agent and monitors its concentration amount at each of a plurality of detection locations in the aircraft.

(d) The present invention is further directed to utilizing a data acquisition software to generate concentration data corresponding to the plurality of concentration amounts and monitoring of the plurality of concentration amounts at the plurality of detection locations, respectively, in substantially real time during testing on the ground or during on-flight testing to allow adjustment of the testing operation on the ground or adjustment and measurement of testing during the flight operation. For example, during aircraft certification, on-flight testing may be performed in various flight modes of an aircraft simulating an on-flight fire suppression discharge, and the present invention provides the unique advantageous feature to monitor the plurality of concentration amounts at the plurality of detection locations, respectively, in substantially real time. For example, during on-flight testing, this advantageous feature allows an operator of the aircraft to modify subsequent testing operations or the flight operation based on the concentration data regarding a first testing operation monitored in substantially real time. An operator as used throughout the application herein may refer to any operator, user, technician, pilot, or person controlling any testing or flight operation.

(e) The present invention further provides a remote test sequence module that may be utilized from the ground to control fire suppression discharge and monitoring of the fire suppression agent for a pilotless vehicle such as a drone.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 6B is a chart for recording data in conjunction with the method shown in FIG. 6A;

FIG. 14 is a sequential table showing an example of the timing sequence of operations of the remote test sequence unit performed in a first sequence.

DETAILED DESCRIPTION OF THE PREFERRED EMBODIMENTS

Figure 1:
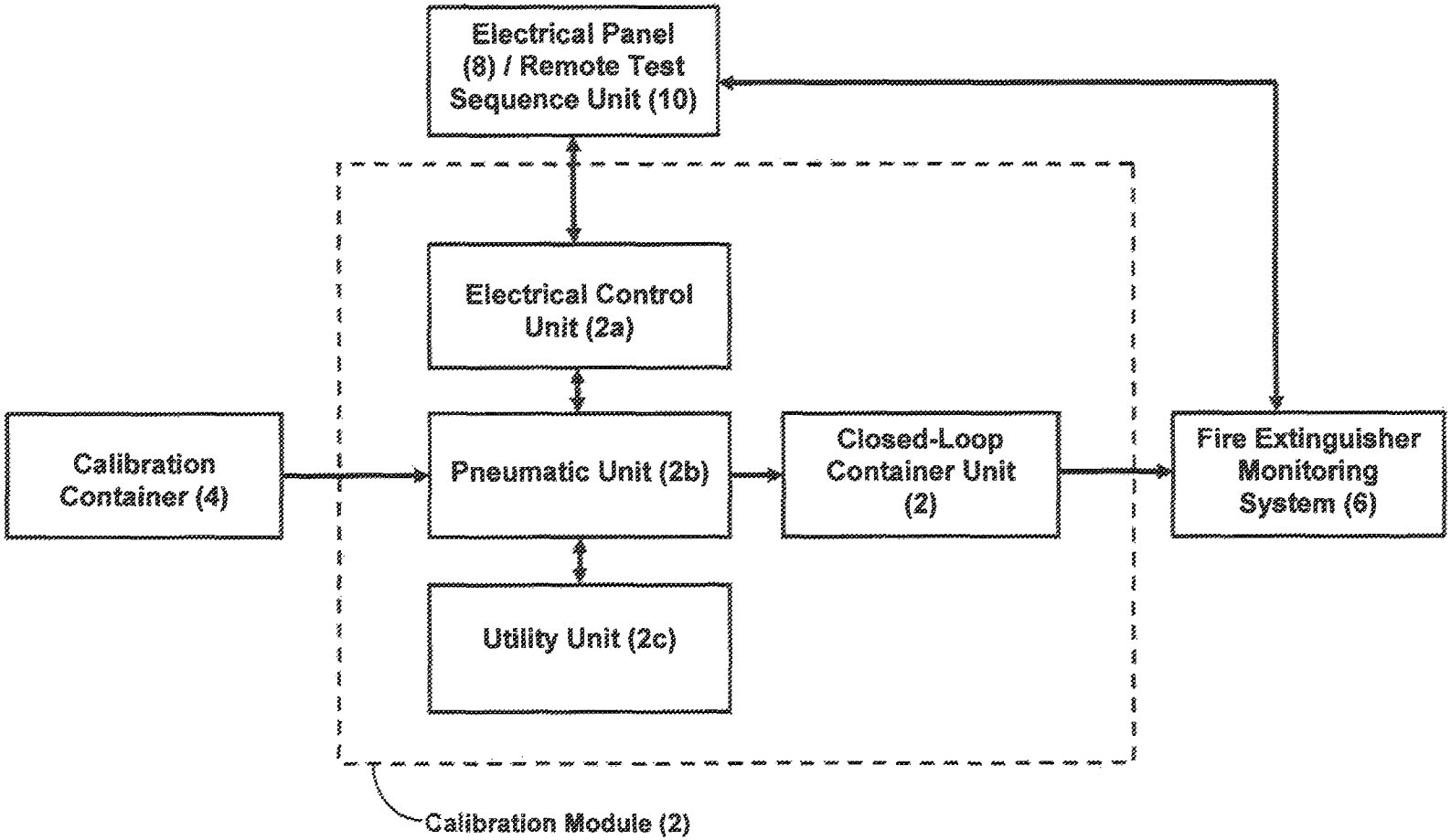
FIG. 1 is a schematic block diagram of a calibration module coupled to a calibration container and configured to calibrate a fire extinguisher monitoring system.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Reference will now be made in detail to the preferred embodiments of the invention which set forth the best modes contemplated to carry out the invention, examples of which are illustrated in the accompanying drawings. While the invention will be disclosed in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components and circuits have not been disclosed in detail as not to unnecessarily obscure aspects of the present invention.

The present invention is in part directed to a calibration module for calibrating a plurality of detectors and verifying a plurality of concentration amounts over time at a plurality of detection locations, respectively. An addition of a calibration module is used to determine whether each of the plurality of concentration amounts at the plurality of detections locations, respectively, is maintained at or above a minimum concentration amount (for example, 6% for Halon 1301 and 17.6% for HFC-125) for at least a minimum time period. Unlike the devices in the art directed to 100% concentration agents, the calibration module has the unique advantage of delivering various concentration levels (e.g., within a predetermined range of 6% to 18%) for precise calibration that accurately simulates discharge facing airflow at an altitude. The verification can be further used to certify a fire extinguisher monitoring system (for example, a fire extinguisher gas chromatograph system). In one embodiment of the present invention, the concentration amounts are monitored at twelve detection locations. However, it can be appreciated that an additional or less number of detection locations may be monitored without limiting the scope of the present invention.

The present invention is further directed to utilizing a data acquisition software to generate concentration data corresponding to the plurality of concentration amounts and monitoring of the plurality of concentration amounts at the plurality of detection locations, respectively, in substantially real time during testing to allow for adjustment of the testing operation. The calibration data may be analyzed on the field to adjust the distribution and/or probing of the fire suppression agent. For example, one or more sensor probes at the plurality of detection locations 62 may be relocated after analyzing the calibration data on the field.

FIG. 1 is a schematic block diagram of a calibration module 2 coupled to a first calibration container 4. The calibration module 2 may control receiving a mixture containing a fire suppression agent and an airflow-simulating fluid from the first calibration container 4 and utilizing the mixture to fill a closed-loop container 12*a* in a closed-loop container unit 2*d*. In one embodiment, because the mixture in the first calibration container 4 is of high pressure, a vacuum pump may not be necessary to draw the mixture into the closed-loop container 12*a*. The calibration module 2 further dynamically controls delivery of a fire suppression agent from the first calibration container 4 to a fire extinguisher monitoring system 6, for example using a vacuum pump or source. In one embodiment as shown in FIG. 1, the calibration module 2 has at least the following four main units: an electrical control unit 2*a*, a pneumatic unit 2*b*, a utility unit 2*c*, and a closed-loop container unit 2*d*. The operations of each of the preceding units are disclosed below with respect to FIG. 2.

Figure 2:
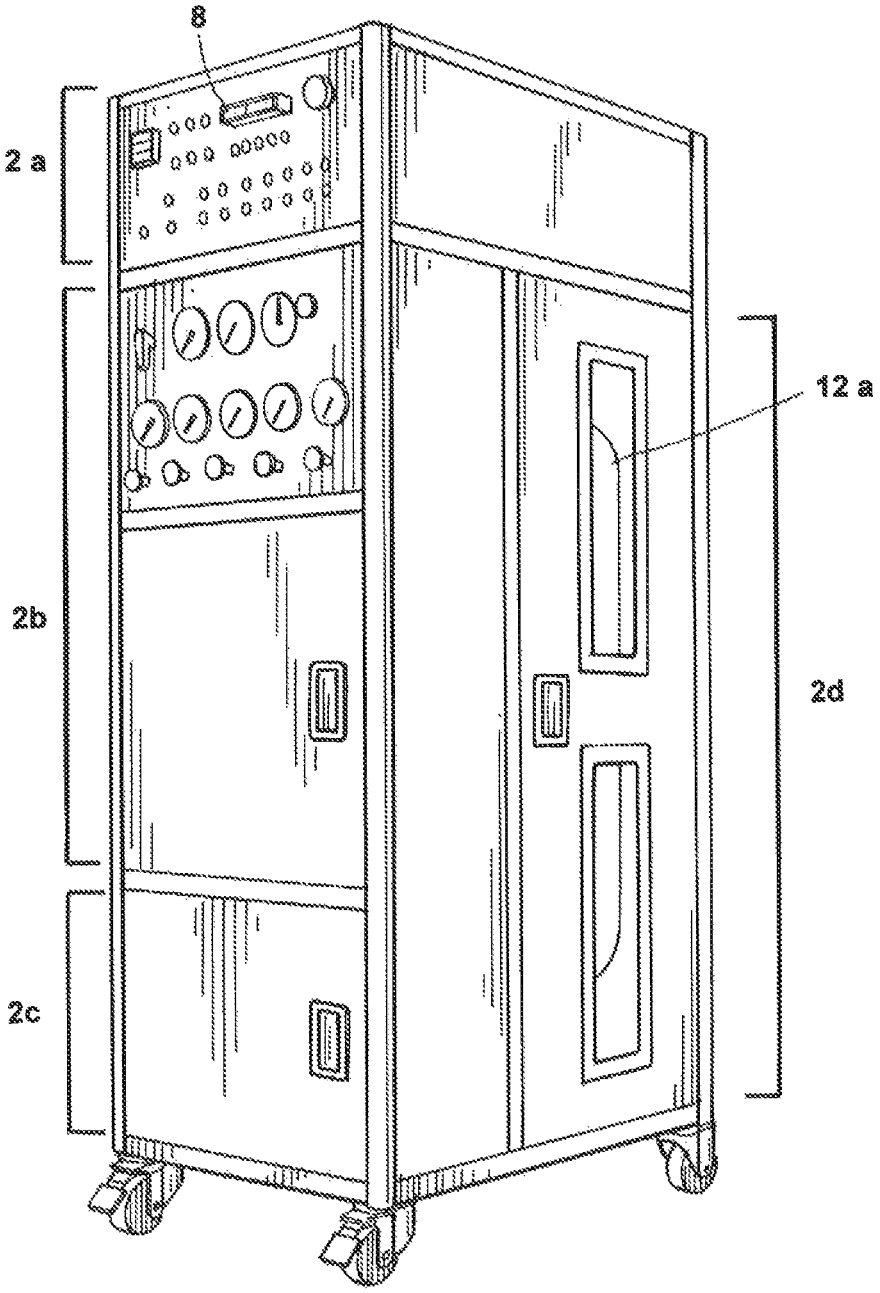
FIG. 2 is a perspective view of an exemplary embodiment of the calibration module mounted in a calibration tower.

FIG. 2 shows a perspective view of the four main units mounted in a "calibration tower" that is an exemplary embodiment of the calibration module 2.

The pneumatic unit 2*b* may include means for establishing a fluid connection (e.g., hoses, conduits, or hook-ups) with a first calibration container 4. The pneumatic unit 2*b* may include a pressure gauge for each of the connected plurality of calibration containers 16, respectively, to monitor the pressure therein. The pneumatic unit 2*b* may further include a pressure gauge to monitor the pressure within a closed-loop container 12*a*, respectively. The pneumatic unit 2*b* may further include a plurality of tube quick disconnect couplings and spider tube manifolds for delivering the mixture in the closed-loop container 12*a* to the fire extinguisher monitoring system 6. Other means may be used to deliver a mixture from a first calibration container 4 to the closed-loop container 12*a* and from the closed-loop container 12*a* to the fire extinguisher monitoring system 6.

An electrical control unit 2*a* may control electrical operations of the calibration module 2. As shown in FIGS. 1 and 2, the electrical control unit 2*a* may be connected to an electrical panel 8. The electrical control unit 2*a* may include a main power unit for powering the calibration module 2. The operations may be performed automatically or semi-automatically. An operator may initiate and control the operations of the calibration module 2 using the electrical panel 8. Alternatively or in addition, a remote test sequence unit 10 may be provided, thereby allowing an operator to remotely control operations of the calibration module 2. The electrical panel 8 and the remote test sequence unit 10 may provide an interface for the technician to control humidity and temperature and may further provide semiautomatic switches with press buttons for operating heaters, humidifier, lights, mixing fans, a vacuum and a press button for stopping the operation in the event of an emergency. It can be appreciated that although the electrical panel 8 may contain switches, in other embodiments, a computer user interface such as a touch-screen display may be provided, in addition or alternatively, for allowing the electrical control unit 2*a* to receive an input from the operator to perform any of the preceding operations. It can be further appreciated that although some of the operations are disclosed as being operated manually using switches or semi-automatically, each of the preceding operations may be configured to be performed automatically, and vice versa, based on design considerations and safety concerns.

The utility unit 2*c* may include an air filter and may further include a first vacuum pump that may be controlled by the electrical control unit 2*a* for vacuuming the contents of the first calibration container 4.

The closed-loop container unit 2*d* includes the closed-loop container 12*a* and fluidly connects the closed-loop container 12*a* to the pneumatic unit 2*b*. The closed-loop container 12*a* may be, for example, an inflatable bag made of polyethylene and an internal volume of 2.2 cu. ft. A mixer column assembly may be positioned inside the closed-loop container 12*a* for maintaining a homogeneous flow. The pneumatic unit 2*b* may further include pressure and vacuum relief valves for controlling the delivery of mixture from the first calibration container 4 to the fire extinguisher monitoring system 6.

The delivery of the mixture from the closed-loop container unit 2*d* to the fire extinguisher monitoring system 6 involves the vacuum pump(s) in the fire extinguisher monitoring system 6. For example, the vacuum pump(s) may have a capacity of 1.1 cubic feet/min. Other vacuum sources other than a pump may further be used without limiting the scope of the present invention. The vacuum pump(s) may be used to draw the mixture from the closed-loop container 12*a* through a plurality of channels 14 to fire extinguisher monitoring system 6.

Figure 3:
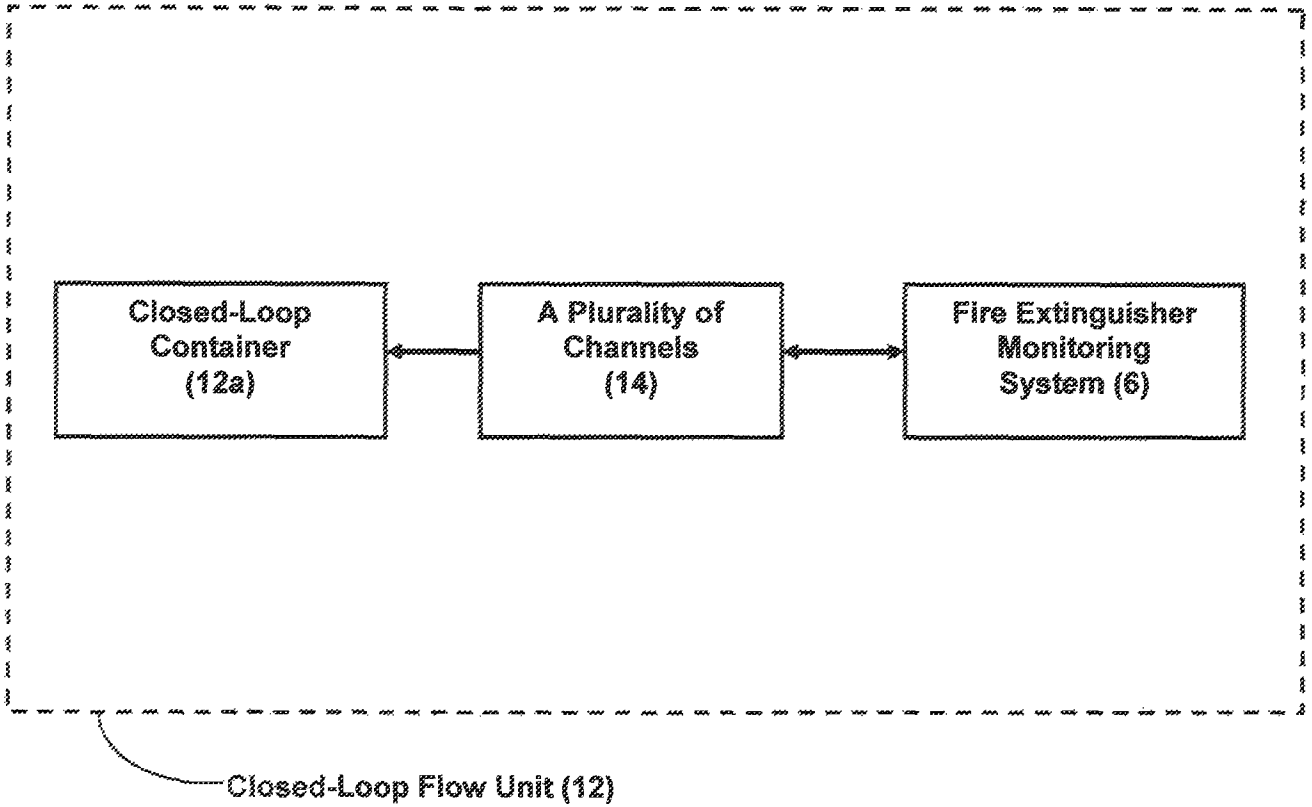
FIG. 3 is a schematic block diagram of a closed-loop flow unit.

FIG. 3 is a schematic block diagram of a closed-loop flow unit 12 that includes the closed-loop container 12*a*, the plurality of channels 14, and the fire extinguisher monitoring system 6. The plurality of channels 14 may include for example, twelve capillary tubes and a twelve tube disconnect coupling to deliver a mixture from the closed-loop container 12*a* to twelve detection locations. In other embodiments, less or more tubes, conduits, or channels may be utilized to deliver a mixture from the closed-loop container 12*a* to a plurality of detection locations based on the level of accuracy desired, number of desirable measurement points, and other design concerns. The vacuum pump(s) in the fire extinguisher monitoring system 6 draws a portion of the mixture through each of the plurality of channels 14 of the closed-loop flow unit 12.

Figure 4:
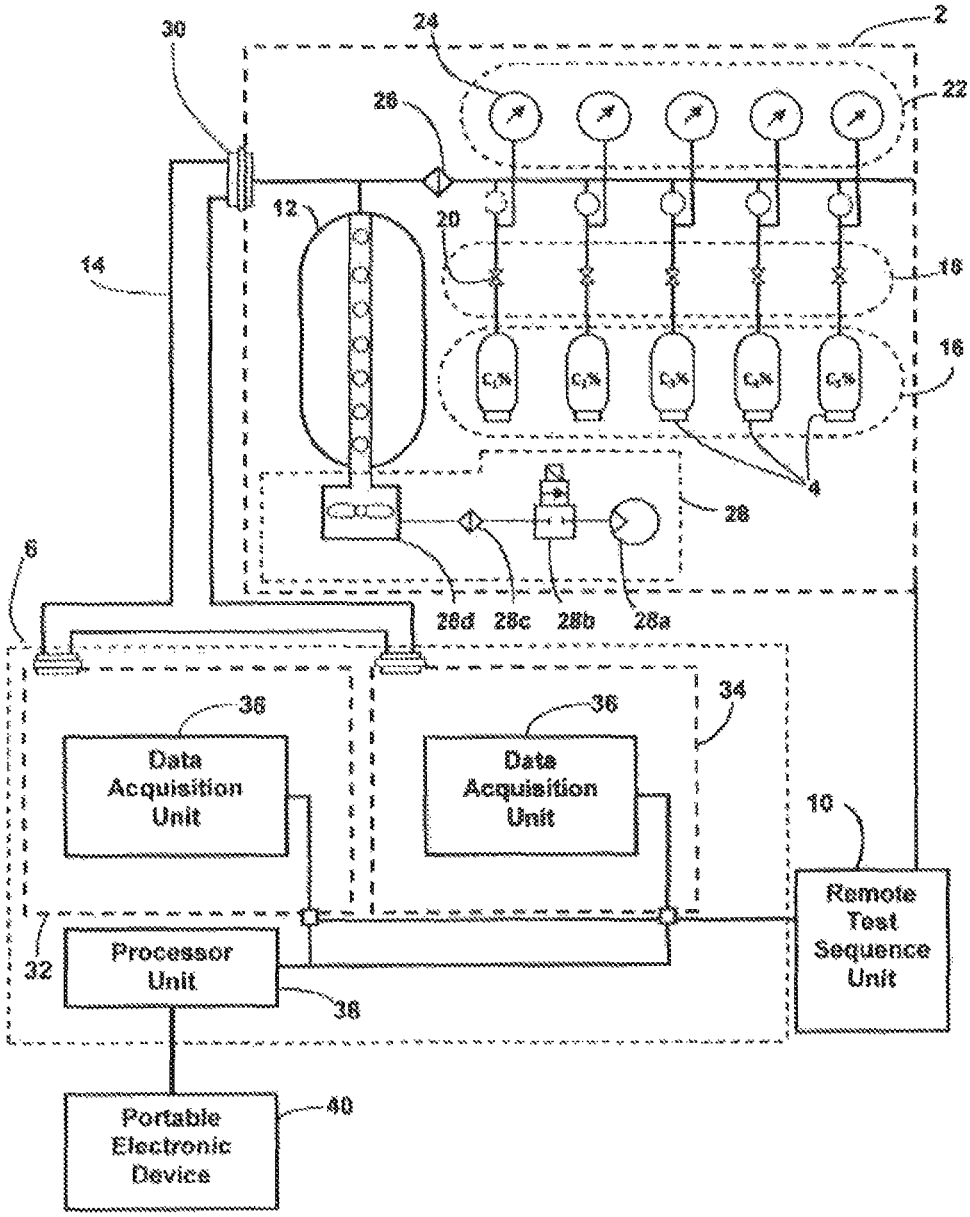
FIG. 4 is a schematic illustration of the calibration module and a remote test sequence unit coupled to a fire extinguisher monitoring system.

FIG. 4 is a schematic illustration of the calibration module 2 and the remote test sequence unit 10 coupled to a fire extinguisher monitoring system 6. A plurality of mixtures may be provided in a plurality of calibration containers 16, respectively. One advantageous feature is the ability to calibrate and verify readings of the plurality of detectors of the fire extinguisher monitoring system 6. The detectors may be thermal conductivity detectors (TCD's) or other sensors capable of monitoring a concentration amount, number of moles or a volumetric measure of the fire suppression agent in a mixture. Regardless of the degree of precision in manufacturing of the detectors, each detector has unique characteristics resulting in a reading that may be inconsistent with a reading of a similarly manufactured and similarly positioned detector. A unique advantage of the invention is to verify and calibrate readings of each of the plurality of detectors to determine a baseline of measurement for each of the plurality of detectors.

A further advantageous feature of the present invention is enhancing the precision of the calibration and verification process by performing the testing over a predetermined range of concentration amounts (e.g., 6%-100%), using a plurality of mixtures in the plurality of calibration containers 16, respectively. For example, this can be achieved by providing a calibration module 2 that is configured to sequentially draw the plurality of mixtures from the plurality of calibration containers 16, respectively, after ambient air conditions are tared out as disclosed below. Each of the plurality of concentration amounts at the plurality of detection locations, respectively, can be directly monitored in substantially real time.

To perform the testing operation over the predetermined range, the present invention is in part directed to preparing a plurality of mixtures with critical and precise concentration amounts or moles a fire suppression agent at the test site and/or on the flight before the fire suppression agent is discharged. The calibration process begins with preparing an accurate mixture between the number of moles of fire suppression gas agent and the number of moles of the airflow-simulating fluid (e.g., Nitrogen gas) in the first calibration container 4. In one embodiment, five calibration mixtures are prepared within five calibration containers 16, respectively. It can be appreciated that the number of prepared plurality of calibration containers 16 may be varied based on design needs. For example, preparing a higher number of calibration containers 16 would result in generation of a higher degree of concentration data for direct monitoring and analysis with more representative concentration amounts over the predetermined range of concentration amounts (e.g., 6%-100%). One advantageous feature of the present invention is the capability of preparing the plurality of calibration containers 16 at a variety of test sites as disclosed below.

Each mixture in each of the plurality of calibration containers 16 is a precise combination of an airflow-simulating fluid (e.g., pure Nitrogen gas) and a fire suppression agent (e.g., Halon 1301 gas) which when properly mixed forms the basis of a fire suppression agent with a unique concentration amount within the predetermined range of concentration amounts. Firstly, the process for preparing the plurality of mixtures in the plurality of calibration containers 16 is disclosed with respect to FIGS. 5, 6A, 6B, and 7, and subsequently, the process for sequentially delivering the mixtures to fill a closed-loop container 12*a* (e.g., an inflatable bag) of the calibration module 2 is disclosed.

Figure 5:
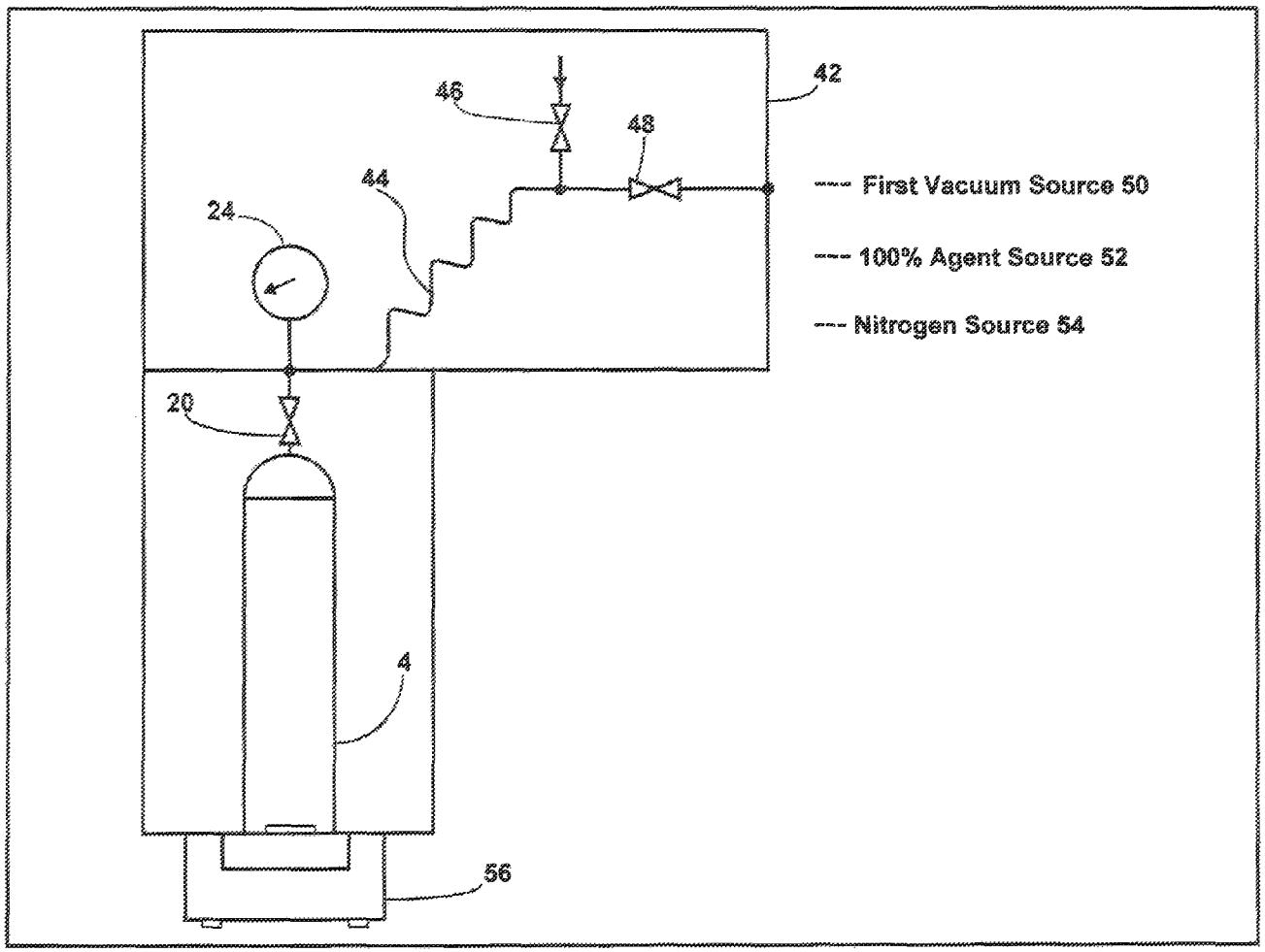
FIG. 5 is a schematic diagram of the calibration container setup system prior to connecting a first calibration container to the calibration module 2.

FIG. 5 is a schematic diagram of the calibration container setup system for preparing, for example, the first calibration container 4 prior to fluidly connecting the first calibration container 4 to the calibration module 2 as shown in FIG. 4.

Figure 6A:
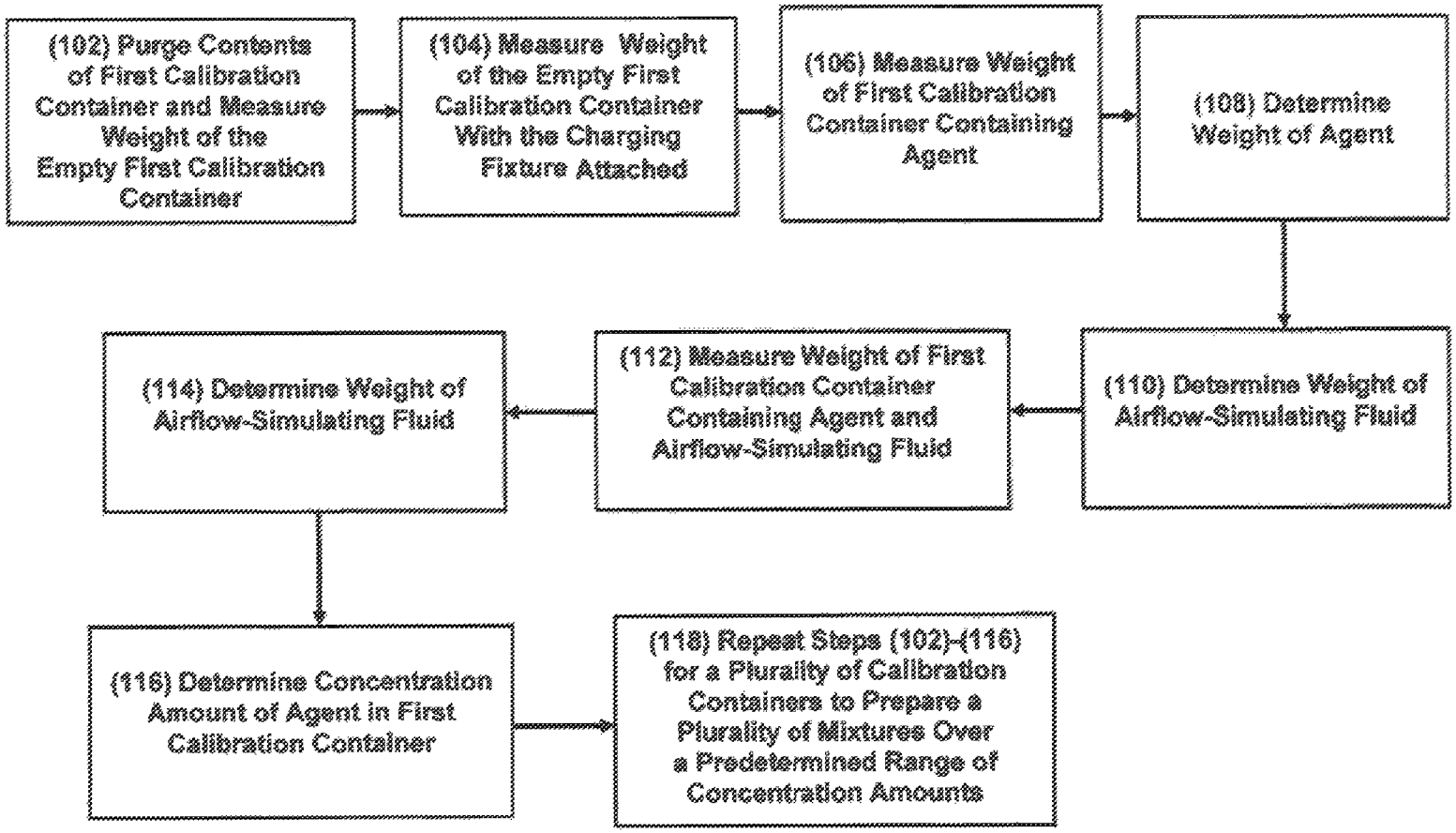
FIG. 6A is a flowchart diagram for determining concentration amounts of fire suppression agents for each of a plurality of calibration containers.

The following procedure describes the preparation methodology and references FIGS. 5, 6A, and 6B. FIG. 6A is a flowchart diagram for determining concentration amounts of fire suppression agents for each of a plurality of calibration containers 16. FIG. 6B is a chart for recording data using the method shown in FIG. 6A.

Referring to step 102 of FIG. 6A, the contents of the first calibration container 4 may be purged or vacuumed. The first calibration container 4 may be a calibration bottle as shown in FIG. 5. The first calibration container 4 may have various others shapes, capacities, or characteristics without limiting the scope of the present invention. The first calibration container 4 may be attached to a first vacuum source 50.

The first valve 20 and the third valve 48 as shown in FIG. 5 may be opened, and the second valve 46 may be closed to empty the contents of the first calibration container 4.

The first vacuum source 50 can then be operated until the first pressure gauge 24 reads roughly 5 inches of Mercury vacuum. At this juncture, the first valve 20 can be closed to prepare an empty first calibration container 4.

Referring to step 102 of FIG. 6A, the first calibration container 4 may be placed on an electronic scale 56 for measuring a weight of the empty (purged/vacuumed) first calibration container 4. The electronic scale 56 may have a ±0.01 gram accuracy. The weight of the empty first calibration container 4 may be recorded on line 202. Next, the charging fixture 42 may be attached to the empty first calibration container 4 as shown in FIG. 5.

Referring to step 104 of FIG. 6A, a weight of the empty first calibration container 4 with the charging fixture 42 attached may be determined using the electronic scale 56 and recorded on line 204 of FIG. 6B.

Referring to step 106 of FIG. 6A, a weight of the first calibration container 4 containing the first suppression agent may be determined in order to determine the weight of the fire suppression agent from steps 104 and 106.

The electronic scale 56 reading of the assembled first calibration container 4 and the filled charging fixture 42 may be tared out. The first valve 20 may be slowly opened to allow the fire suppression agent into the first calibration container 4. When a predetermined weight for the fire suppression agent has been reached, the third valve 48 may be closed.

In one embodiment, although measurements of pressure may be ancillary to determination of the concentration amount of the fire suppression agent, the pressure may be gauged in order to ensure that the calibration module 2 is functioning safely and properly. During the process, the pressure may be monitored using the first pressure gauge 24, and the pressure at this stage may be recorded on line 206 of FIG. 6B. The first valve 20 may then be closed.

A separate empty container is attached to the relief line of the charging fixture 42 and the second valve 46 is opened to remove the fire suppression agent inside the charging fixture 42. When charging pressure has been relieved, the charging fixture 42 is detached from the first calibration container 4 in order to measure the weight of the first calibration container 4 containing the fire suppression agent. Next, the first calibration container 4 is removed from the electronic scale 56. The weight reading of the electronic scale 56 may be tared for further accuracy. The first calibration container 4 is then positioned back on the electronic scale 56, and the weight may be recorded on line 208. Therefore, as shown in step 108 of FIG. 6A, the precise weight of the fire suppression agent is determined by subtracting line 202 from line 208 of FIG. 6B. The resulting pure weight of the fire suppression agent may be recorded on line 210.

A desired weight of an airflow-simulating fluid such as Nitrogen may be determined for preparing a desired first concentration amount of the fire suppression agent. The weight of the airflow-simulating fluid may be recorded on line 212. For providing a precise measurement of the weight of the airflow-simulating fluid, the weight is measured after the first calibration container 4 is filled with the airflow-simulating fluid as follows.

Initially, the contents of the charging fixture 42 may be purged by attaching the third valve 48 to a Nitrogen gas source. The Nitrogen gas source may be opened, and the second valve 46 and the third valve 48 may be opened alternatively to allow a high flow of Nitrogen gas through both a relief line connected to the second valve 46 and a gauge port line connected to the first pressure gauge 24 for example, for at least 15 seconds. The preceding purging process removes any agent remaining within the charging fixture 42.

Referring to step 112 of FIG. 6A, the weight of the first calibration container 4 containing the fire suppression agent and the airflow-simulating fluid is measured in order to determine the weight of the airflow-simulating fluid. The charging fixture 42 is attached to the first calibration container 4. The source of the airflow-simulating agent (e.g., Nitrogen) is already attached to the charging fixture 42 from the previous steps. The second valve 46 is then closed and the third valve 48 opened to allow the airflow-simulating agent to fill the charging fixture 42. The electronic scale 56 reading of the assembled first calibration container 4 and the pressurized charging fixture 42 may be tared out. The first valve 20 may be slowly opened to allow Nitrogen gas into the first calibration container 4. When the desired weight for Nitrogen gas has been reached (as discussed above with respect to line 212 of FIG. 6B), the third valve 48 may be closed. The pressure of the pressurized first calibration container 4 may be gauged and recorded on line 214. The first valve 20 is closed, and the second valve is 46 opened to relieve pressure within the charging fixture 42. After the charging pressure has been relieved, the first calibration container 4 is detached from the first calibration container 4. The first calibration container 4 may be removed from the electronic scale 56 and the reading of the electronic scale 56 may be tared out. The first calibration container 4 is placed back on the electronic scale 56 to measure the weight of the first calibration container 4 containing the fire suppression agent and the air-flow simulating fluid. The weight of the first calibration container 4 containing the fire suppression agent and the Nitrogen gas may be recorded on line 216.

Referring to step 114 of FIG. 6A, the airflow-simulating fluid is determined by subtracting the weight of the first calibration container 4 containing the fire suppression agent on line 208 from the weight of the first calibration container 4 containing the fire suppression agent and the airflow-simulating fluid on line 216. The resulting weight may be recorded on line 218.

Referring to step 116 of FIG. 6A, the concentration amount of the fire suppression agent in the first calibration container 4 may be determined using the weight of the fire suppression agent determined in line 210 and the weight of the airflow-simulating fluid determined in line 218. The resulting concentration amount of the first calibration container 4 may be recorded on line 220 and marked on the first calibration container 4.

Referring to step 118 of FIG. 6A, each of the plurality of calibration containers 16 may be prepared using steps 102 to 116 and the intermediary sub-steps disclosed above.

Referring back to FIG. 4, the plurality of calibration containers 16 are assembled into the calibration module 2 using a plurality of valves 18 in order to draw the contents of the plurality of calibration containers 16 into the closed-loop container 12*a*. In one embodiment, only one of the plurality of valves 18 is opened at a given time in order to avoid intermixing of the plurality of mixtures in the plurality of calibration containers 16. The delivery of the plurality of mixtures may be performed sequentially in order to perform calibration and verification using a plurality of concentration amounts within the predetermined range of concentration amounts. In one embodiment, a plurality of pressure gauges 22 may provide direct readings of the pressure of the plurality of calibration containers 16, respectively.

For example, if the first valve 20 is opened, the pneumatic unit 2*b* may control the delivery of the first mixture in the first calibration container 4 to the closed-loop container 12*a* and then to fire extinguisher monitor system using the electrical panel 8, remote test sequence unit 10 and port 30. Because the first mixture in the first calibration container 4 is of high pressure, use of a vacuum pump may not be necessary for flowing the first mixture into the closed-loop container 12*a*. In one embodiment, the pneumatic unit 2*b* may include a first filter 26 and a calibration flow control unit 28 as shown in FIG. 4 for controlling the flow of the first calibration container 4 that is connected to an open valve of the plurality of valves 18. In one embodiment, the calibration flow control unit 28 may include a first vacuum pump 28*a* that may be utilized to, for example, purge the contents of the closed-loop container 12*a*. The calibration flow control unit 28 may further include a solenoid valve 28*b* for activating and deactivating flow of the first mixture. The calibration flow control unit 28 may further include a second air filter 28*c* and a mixing fan 28*d* for maintaining a homogenous flow of the first mixture from the closed-loop container 12*a* to the fire extinguisher monitoring system 6. The first mixture is delivered to the detection modules 32 and 34 using the plurality of channels 14.

Although only two detection modules 32 and 34 are shown in FIG. 4, it can be appreciated that one or more than two detector modules may be utilized without limiting the scope of the present invention.

An exemplary process of assembling the plurality of calibration containers 16 into the calibration module 2 and operating the calibration module 2 as shown in FIG. 4 is disclosed below.

It may first be verified that the first calibration container 4 is securely assembled in the calibration module 2 and all valves on the pneumatic unit 2*b* are closed. For drawing the contents of the first calibration container 4, only the first valve 20 of the plurality of valves 18 is opened while the remainder of the plurality of valves 18 remains closed. The first pressure gauge 24 should indicate the pressure reading for the first calibration container 4.

Figure 7:
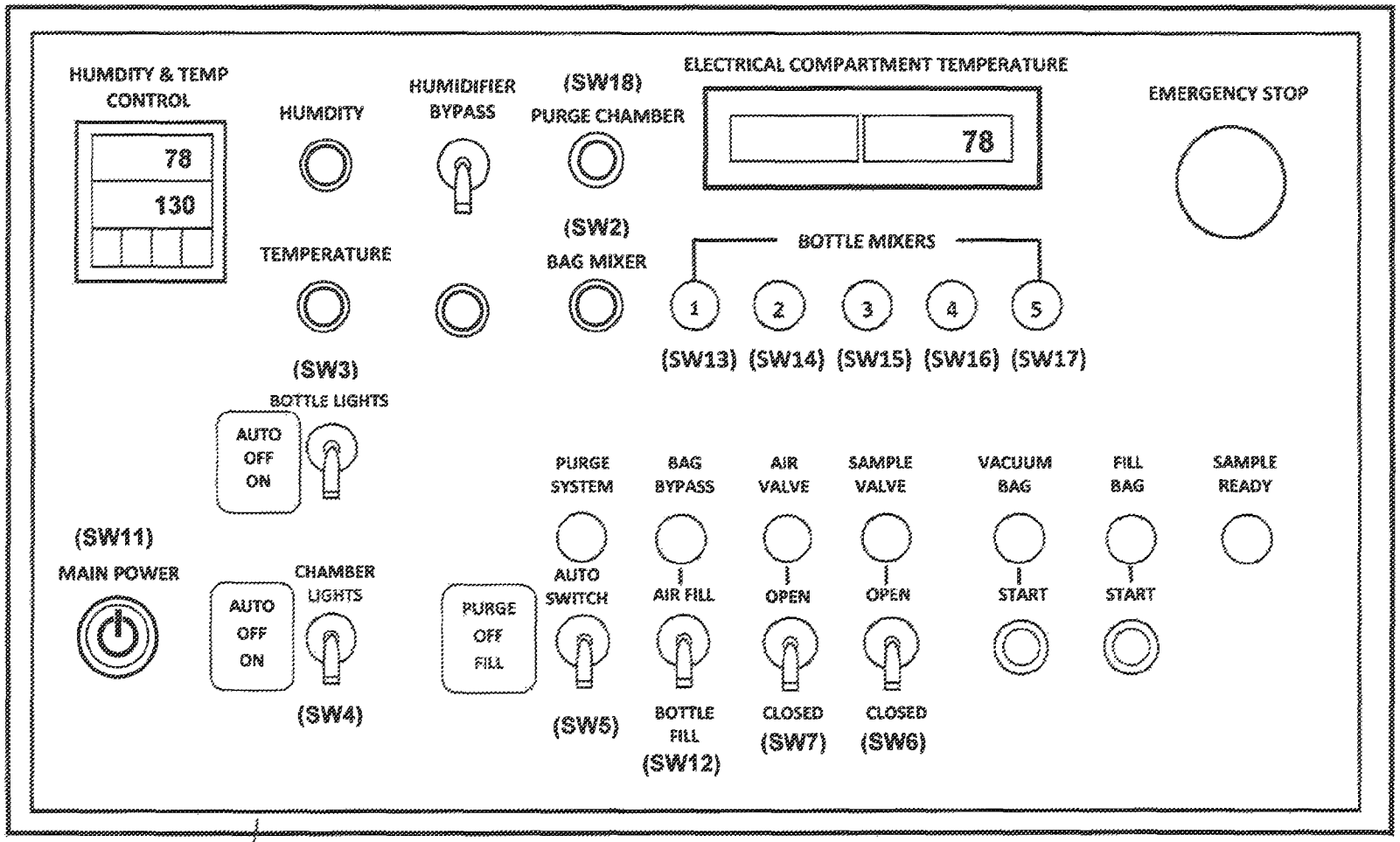
FIG. 7 shows an interface panel of an electrical panel for controlling operations of the calibration module.

FIG. 7 shows an interface panel of the electrical panel 8. Using the interface panel shown in FIG. 7, it can be verified that emergency switches are in pulled out condition from the fire extinguisher monitoring system and its inventor/pump module and that the power switch is turned off for the detection modules 32 and 34.

The plurality of channels 14, all applicable RS232/USB communication cable(s), power cable(s), vacuum tubes and sample tube bundle are connected to the fire extinguisher monitoring system 6. A RS232/USB cable may be used for connections of the processor unit 38. A 28VDC power or utility power of 115VAC, 60 Hz may be connected to an inventor/pump unit of the fire extinguisher monitoring system. In one embodiment, only one of the preceding sources of power is connected, not both.

In one embodiment, because utility power is used for the calibration module 2, the inverter portion of the inventor/pump assembly is not used. The inverter/pump assembly is connected to utility power to deliver power to the vacuum pumps.

After verifying that the inventor/pump assembly is connected to the utility power, the fire extinguisher monitoring system may be powered on. The softwares in the portable electronic device 40 may be initiated and connectivity with the data acquisition units 36 may be verified. Any processor capable of operating the commands of the softwares may be utilized in addition to or in lieu of the portable electronic device 40 without limiting the scope of the invention. In one embodiment, the operations described herein with respect to the processor unit 38 and the portable electronic device 40 may be performed in one or more processor(s) without limiting the scope of the present invention.

As disclosed with respect to FIGS. 1 and 2, the electrical control unit 2*a* may electronically control the operations of the calibration module 2. In one embodiment, the electrical control unit 2*a* may include an electrical panel 8 or may work in conjunction with a remote test sequence unit 10. The plurality of calibration containers 16 may be connected to the pneumatic unit 2*b* using flexible and hard tubing for establishing fluid communications.

Referring to FIGS. 4 and 7, a process of controlling the calibration process using the calibration module 2 is disclosed below. Switch (SW11) may be set to an on state for actuating the main power for the calibration module 2. Mixers for the plurality of calibration containers 16 may be set to an on state by using switches (SW13) through (SW17) as required. The calibration module 2 may be operated automatically by placing toggle switches (SW5), (SW6), (SW7), (SW10) and (SW12) in the downward position. For manual control of the calibration module 2, switches (SW5), (SW6), (SW7), (SW10) and (SW12) can be toggled in the upward position and can be turned off when they are flipped in the middle position. In one embodiment, switch (SW18) can be pressed for rapidly ventilating and purging chambers within the calibration module 2 as needed. Lights of the calibration module 2 may be toggled on using switches (SW3) and (SW4) as needed. The mixing fan 28*d* may be actuated by setting switch (SW2) to an on state. At this juncture, the calibration module 2 is ready to receive commands from a software run by the portable electronic device 40 ("PeakSimple" software) in order to initiate an automated filling of the closed-loop container 12*a*.

In an embodiment, the PeakSimple software transmits LED signal to the remote test sequence unit 10, and the operation of the electrical control unit 2*a* automatically initiates filling the closed-loop container 12*a* upon receiving the signal by (a) vacuuming the closed-loop container 12*a* (e.g., an inflatable bag); (b) opening and closing the solenoid valve 28*b*; (c) filling the closed-loop container 12*a* with a specific agent concentration mixture of the first calibration container 4 and at a low pressure (e.g., around 1 psig); and (d) awaiting next event profile subroutine from the portable electronic device 40 to initiate drawing a mixture from the calibration module 2 to the fire extinguisher monitoring system 6.

In another embodiment, the electrical panel 8 of FIG. 7 may show an electronic panel of the remote test sequence unit 10 configured to control the operations disclosed above at a distance from the calibration module 2.

An advantageous feature of the present invention is utilizing a "PeakSimple" software that allows the calibration process disclosed above to take into account particular characteristics of each of the plurality of detectors. As such, airflow characteristics at the test site on the ground and at an altitude of a flight operation may be tared out in order to determine a measurement baseline for each of a plurality of detectors utilized to monitor the fire suppression agent discharge.

Figure 8A:
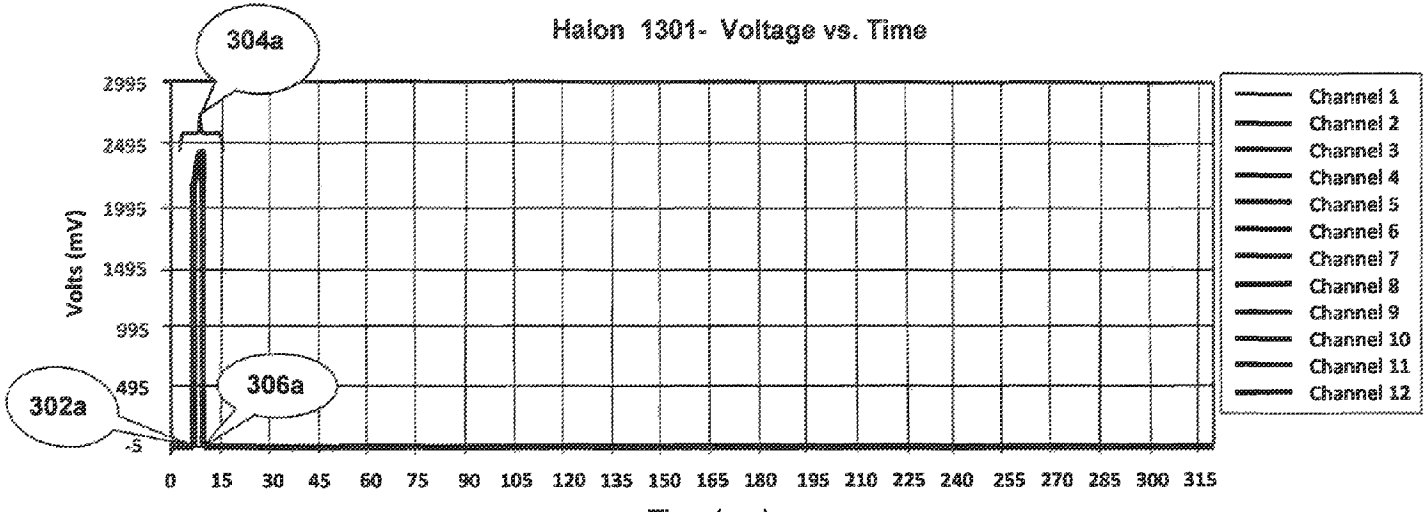
FIG. 8A is a tare plot diagram showing a process of taring out voltage readings of a first detector of the plurality of detectors.
Figure 8B:
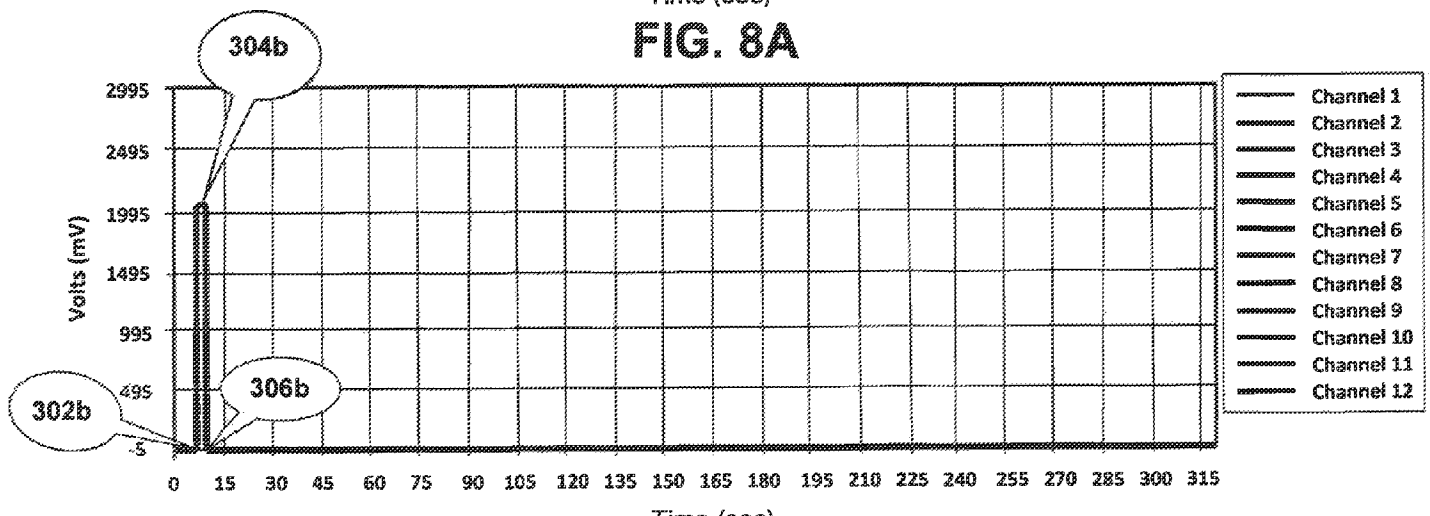
FIG. 8B is a tare plot diagram showing a process of taring out voltage readings of a second detector of the plurality of detectors.

FIG. 8A is a tare plot diagram showing a process of taring out voltage readings of a first detector of the plurality of detectors. FIG. 8B is a tare plot diagram showing a process of taring out voltage readings of a second detector of the plurality of detectors. In one embodiment, at an initial stage before the plurality of mixtures are drawn through the plurality of detectors, each detector is calibrated by drawing ambient air through the plurality of detectors.

In both FIGS. 8A and 8B, the first and the second detectors used are thermal conductivity detectors and the outputs are measured in millivolts (ordinate) over time (abscissa). Points 302*a* and 302*b* indicate the initial response of the first and the second detectors, respectively, when they are turned on initially. When an ambient airflow is drawn through each of the first and the second detector, the output of the first detector reaches point 304*a* whereas the output of the second detector reaches point 304*b*. As can be appreciated from FIGS. 8A and 8B, the output of the first detector reaches point 304*a* that is closer to 2495 millivolts than 1995 millivolts, whereas the second detector reaches point 304*b* that is closer to 1995 millivolts. The discrepancy is partly due to the fact that every detector responds to the fire suppression agent differently to some extent, regardless of the degree of manufacturing precision and uniformity.

As shown in FIG. 8A, the software negates all previous readings of the first detector, resulting in an instant "zero" for the first detector (denoted by point 306*a*) to provide a measurement baseline. Similarly, as shown in FIG. 8B, the software negates all previous readings of the second detector (denoted by point 306*b*), resulting in an instant "zero" reading for each of the first and second detectors. As such, a "zero" measurement baseline is provided for each of the plurality of detectors to provide consistency between the readings of the plurality of detectors and to further rule out the effect of the surrounding environment characteristics on the accuracy of the output responses.

Therefore, an advantageous feature of the present invention is that extraneous factors such as altitude of the aircraft, humidity present at the dynamic flow characteristics and large temperature variations depending on the aircraft's flight path and weather characteristics do not considerably affect the precision of the testing, measurements, and generation of concentration data. Because the characteristics are tared out on the ground and at an altitude of a flight operation, the precision of testing is significantly enhanced, rendering the monitoring of the concentration amounts immune to inaccuracies due to external characteristics of the surrounding environment. Although the output responses of only two detectors are shown for illustration purposes, output responses of various numbers of detectors may be tared out using the same principle disclosed above.

In one embodiment, an optional verification/qualification step may be performed to confirm that the previous readings of the plurality of detectors are tared out and that the readings of each of the plurality of detectors are immune to surrounding air characteristics (e.g., the humidity). The closed-loop container 12*a* may be filled with the airflow-simulating fluid (e.g., Nitrogen) and infused with water vapor until the relative humidity reaches a minimum humidity value (e.g., 20%), and the tare-out process disclosed above is performed to tare out previous readings of each of the plurality of detectors under the reached humidity. This procedure may be performed to log humidity data and/or confirm that the outputs of each of the plurality of detectors are immune to the effects of the air characteristics such as the humidity. In an embodiment, the humidity measurement step may be eliminated given that the air characteristics (including humidity) are tared out and would not significantly affect the readings of the plurality of detectors.

Another advantageous feature of the present invention is utilizing the data acquisition software to provide direct read-out of the concentration amounts at each of the plurality of detection locations in substantially real time.

For example, a portable electronic device 40 (e.g., a laptop computer) coupled to or in communication with the processor unit 38 may be provided to monitor each of the plurality of concentration amounts at the plurality of detection locations in substantially real time, respectively. It can be appreciated that various other types of computer systems including a stationary computer system may be utilized in addition to or in lieu of the portable electronic device 40 without limiting the scope of the present invention.

Figure 9:
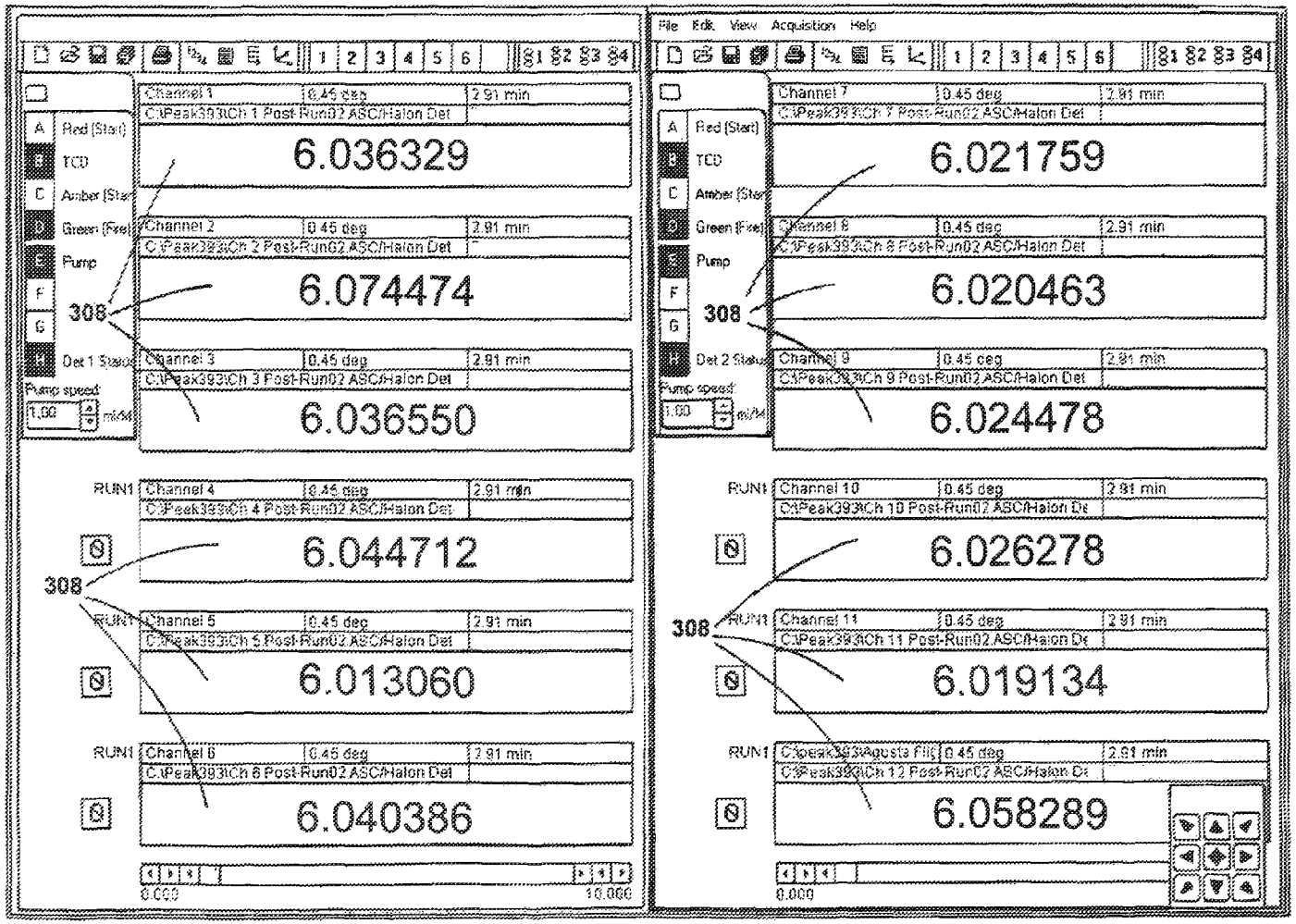
FIG. 9 is a snapshot display of a computer screen showing concentration amounts of the fire suppression agent across at each of the plurality of detection locations.

FIG. 9 is a snapshot display of a screen of the portable electronic device 40 showing concentration amounts of the fire suppression agent across at each of the plurality of detection locations. The example output is the concentration read-outs across the plurality of channels 14 (e.g., twelve channels) using the first calibration container 4 with 6% concentration of Halon as the fire suppression agent. As can be seen in this example, the direct monitoring in substantially real time can verify that each of the twelve concentration amounts 308 at the twelve detection locations, respectively, is maintained above the minimum required 6% concentration amount. In addition, the plurality of concentration amounts may be monitored over time to determine if the minimum concentration amount is maintained for at least a minimum time period (e.g., 0.5 seconds).

Figure 10:
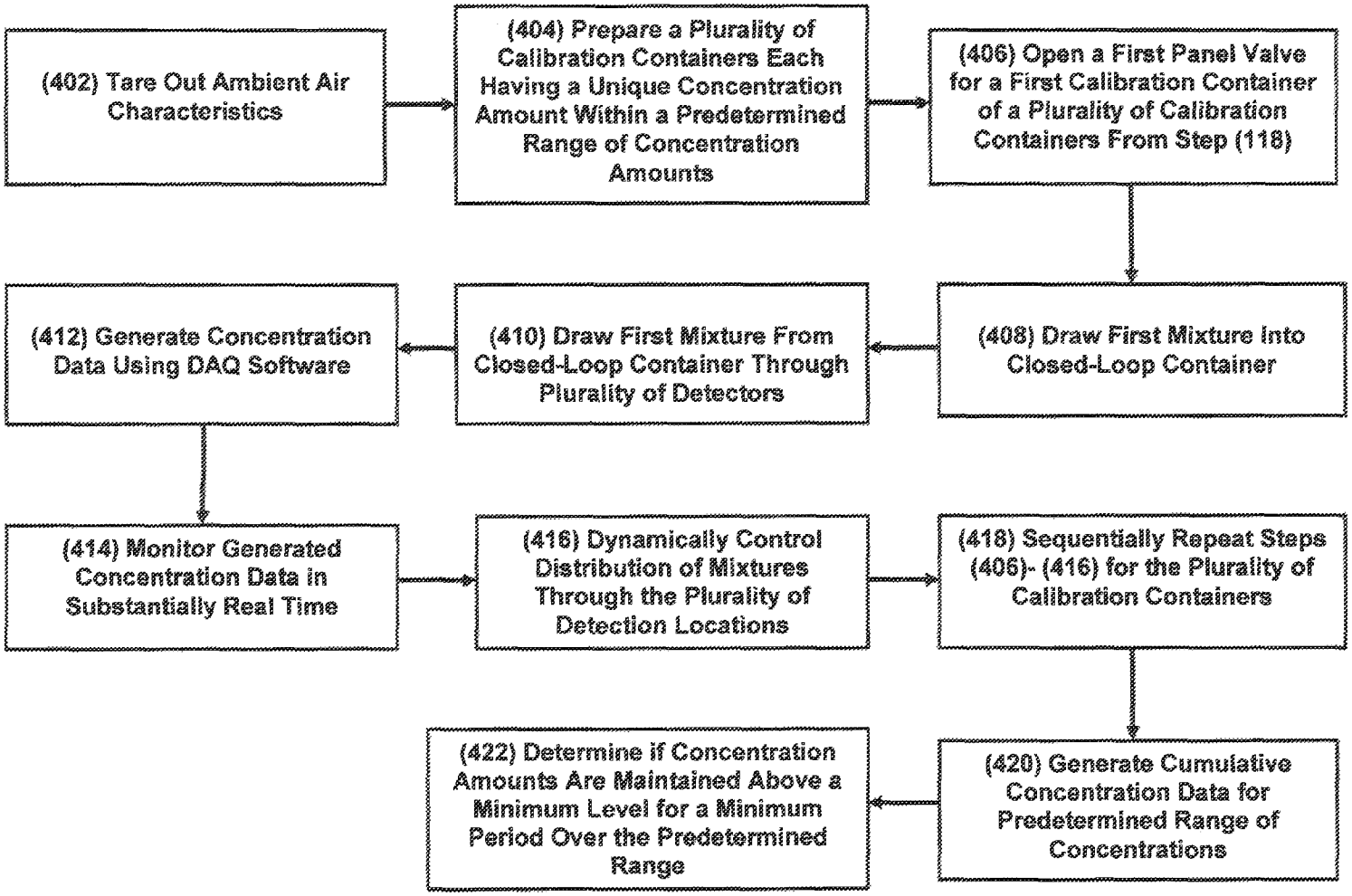
FIG. 10 is a flowchart diagram for calibrating a plurality of detectors using the calibration module and determining whether each of the plurality of concentration amounts is maintained above a minimum level for a minimum time period over a predetermined range of concentration amounts.

FIG. 10 is a flowchart diagram for calibrating a plurality of detectors using the calibration module 2 and determining whether each of the plurality of concentration amounts is maintained above a minimum level for a minimum time period over a predetermined range of concentration amounts. FIG. 10 in part summarizes the relationship between the processes disclosed above.

In step 402, initially, ambient air characteristics are tared out as disclosed above with respect to FIGS. 8A and 8B. In step 404, a plurality of calibration containers 16 may be prepared using the process disclosed with respect to FIGS. 5, 6A, and 6B. For example, each of the plurality of calibration containers 16 may contain a mixture with a unique concentration amount over a predetermined range of concentration amounts. In another embodiment, step 404 may be performed prior to step 402.

In step 406, one of the plurality of valve (e.g., the first valve 20) is opened as disclosed with respect to FIGS. 1-4, and in step 410, the first mixture is drawn from the first calibration container 4 to the closed-loop container 12*a* as disclosed with respect to FIGS. 1-4. In step 410, the first mixture is drawn to the fire extinguisher monitoring system 6 as disclosed with respect to FIGS. 1-4 and 7. In step 412, concentration data is generated using a data acquisition software as explained with respect to FIG. 9. In step 414, the generated concentration data may be directly read out in substantially real time. Referring to step 416, the direct read-out allows for dynamically controlling distribution of mixtures through the plurality of detection locations. Referring to step 418, the steps 406-416 may be repeated for each of the plurality of calibration containers 16. The data acquisition software may compile cumulative concentration data to plot the detected concentration amounts at each of the plurality of detection locations over the predetermined range of concentration amounts of the fire suppression agent (e.g., 6%-18%). In step 422, the cumulative concentration data of step 420 indicates whether each of the plurality of concentration amounts at the plurality of detection locations, respectively, is maintained above a minimum level (e.g., 6% of Halon 1301) for at least a minimum time period (e.g., 0.5 seconds) over the predetermined range (e.g., 6%-18%). It can be appreciated that any of the steps disclosed above with respect to FIGS. 1-10 may be performed in a different order with respect to the other disclosed steps without limiting the scope of the present invention.

Another advantageous feature of the invention is to utilize a remote test sequence unit 10 to coordinate the sequence of events performed on the fire extinguisher monitoring system 6 with flight operations until the optimal testing time period is reached to discharge the fire extinguisher.

Figure 11:
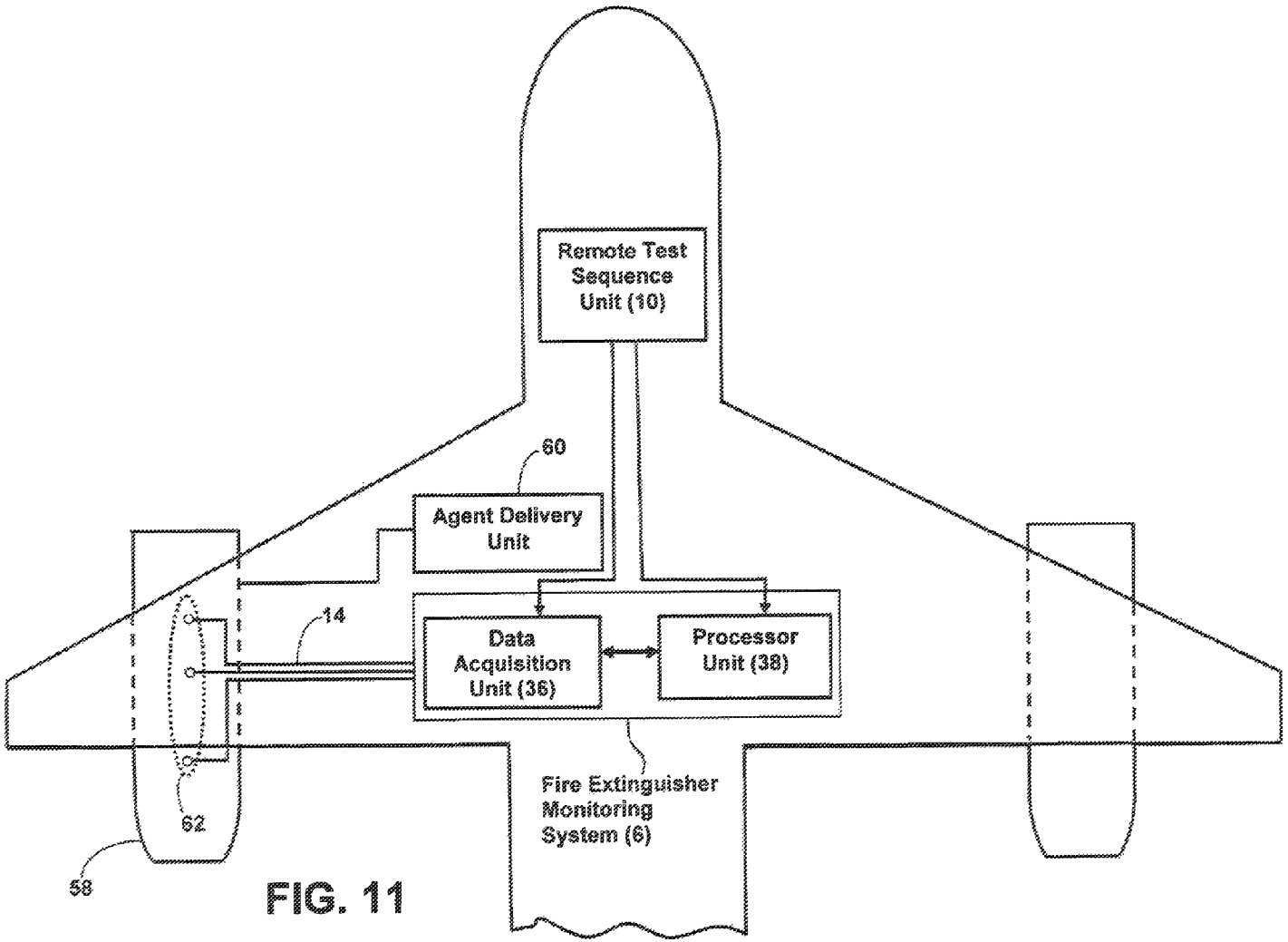
FIG. 11 is a schematic drawing of a remote test sequence unit utilized during a flight operation.

FIG. 11 is a schematic drawing of a remote test sequence unit 10 utilized during a flight operation. An agent delivery unit 60 may be mounted on the aircraft for delivering a fire suppression agent to fire prone areas of the aircraft. Although one fluid connection with an engine nacelle 58 is shown, it can be appreciated that one or more agent delivery unit(s) 60 may deliver the fire suppression agent to a plurality of delivery locations that may correspond to a plurality of fire prone locations in the aircraft including but not limited to other portions of the engine nacelle 58 or other engine nacelles, a cargo space, or an auxiliary power unit. In one embodiment, the agent delivery unit 60 is configured to draw the fire suppression agent from a container (e.g., a bottle) containing the fire suppression agent from the agent delivery unit 60 to the plurality of fire prone locations. The operator may activate firing of the fire suppression agent from the agent delivery unit 60 to the fire prone areas based on a discharge-readiness indicator of the remote test sequence unit 10 that indicates a fire optimal testing time period for discharging the fire suppression agent for allowing direct monitoring of the plurality of concentration amounts at a plurality of detection locations in substantially real time.

As shown in FIG. 11, a plurality of channels 14 may be in fluid communications with each of a plurality of detection locations 62. A fire extinguisher monitoring system 6 may be mounted in the aircraft to detect a plurality of concentration amounts of the fire suppression in a plurality of detection locations within the aircraft, respectively. For example, some of the plurality of detection locations may be within the engine nacelle 58. Although three fluid connections with an engine nacelle 58 is shown, it can be appreciated a plurality of detection locations 62 fluidly connected to the fire extinguisher monitoring system 6 and may correspond to a plurality of fire prone locations in the aircraft including but not limited to other portions of the engine nacelle 58 or other engine nacelles, a cargo space, or an auxiliary power unit.

An advantageous feature of the present invention is utilizing the remote test sequence unit 10 to determine an optimal testing time period for discharging an operation of the fire suppression agent during a flight operation. A further advantageous feature of the present invention is that the characteristics of the airflow at the altitude of the testing operation can be tared out in order to provide a measurement baseline. As such, unlike the devices in the art that are susceptible to inaccuracies due to their inability to take into account the surrounding airflow characteristics (e.g., temperature, pressure, etc.), the present invention has the advantageous capability to draw the surrounding airflow at the altitude of the flight operation and tare out the readings of each of the plurality of detectors to provide a measurement baseline for each of the plurality of detectors. The first optimal testing time period begins after the previous readings of each of the plurality of detectors are tared out. The plots for taring out the output responses of each of the plurality of detectors are similar to FIGS. 8A and 8B disclosed above with respect to negating and zeroing previous readings of each of the plurality of detectors. Therefore, an advantageous feature of the present invention is to perform testing during a first optimal testing period during which the present invention is immune to variations in testing condition due to variations, for example, in airflow characteristics.

In one embodiment, the remote test sequence unit 10 receives a first start-sequence input to initiate taring out ambient air at the altitude of the flight operation for enhancing the accuracy of the measurements.

Figure 12:
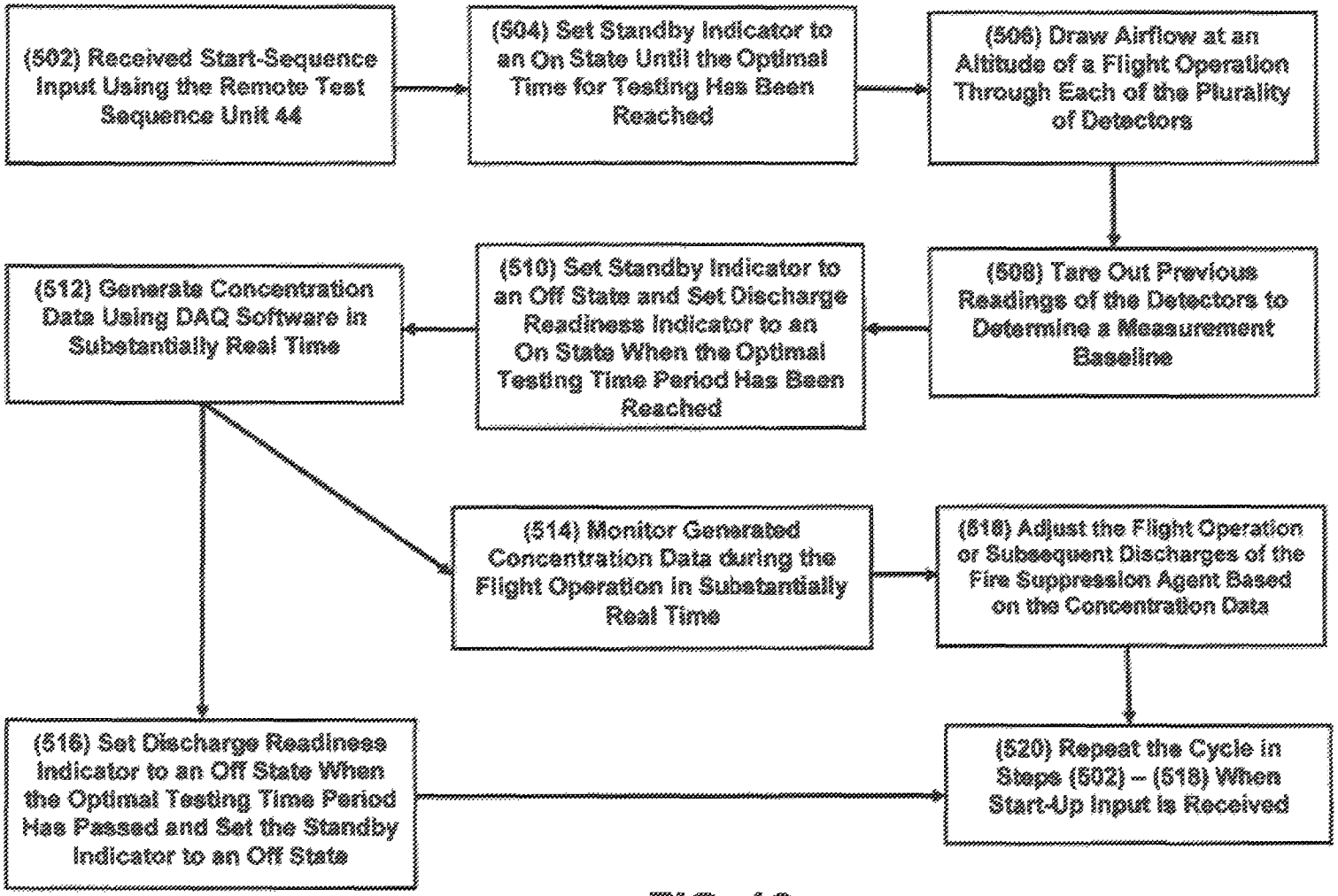
FIG. 12 is a flowchart diagram showing operations of the remote sequence unit.
Figure 13:
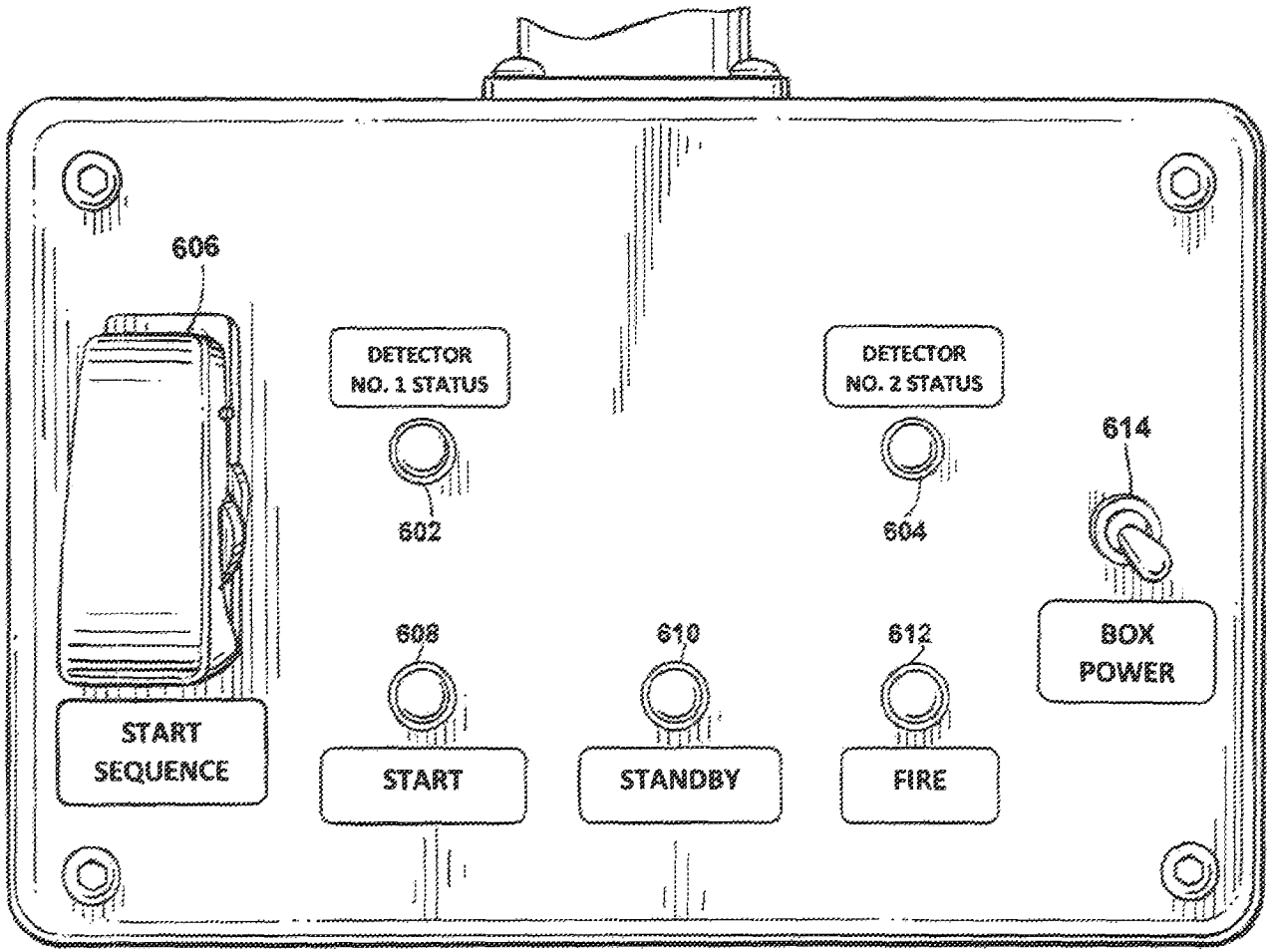
FIG. 13 shows an interface panel of a remote test sequence unit utilized during a flight operation of an aircraft.

An example of a first sequence of operations of the remote test sequence unit 10 is disclosed below with references to FIGS. 12-14. FIG. 12 is a flowchart diagram showing operations of the remote test sequence unit 10. FIG. 13 shows an interface panel of a remote test sequence unit utilized during a flight operation of an aircraft. FIG. 14 is a sequential table showing an example of the timing sequence of operations of the remote test sequence unit performed in a first sequence.

Referring to step 502 of FIG. 12, a first start-sequence input may be received using the remote test sequence unit 10 to initiate operations of the fire extinguisher monitoring system 6 and to initiate drawing an airflow at the altitude to tare out readings of each of the plurality of detectors and to initiate agent concentration data acquisition event sequence.

In one embodiment, when ready to perform the concentration test, the operator may use the start-sequence input 606 to initiate the sequence of operations. In such an embodiment, it may be desirable to allow manual initiation of the sequence of operations given that the operator (such as a pilot) may first need to determine whether a speed, altitude, and other current conditions of a flight operation of the aircraft is currently suitable and safe for shutting off an engine of the aircraft and discharging the fire suppression agent to allow direct monitoring of the plurality of detection locations. In one embodiment, in order to start the first sequence, the operator needs to toggle the switch upward and downward. For example, in the first column 702 and the second column 704 of FIG. 14, it can be seen that at the initial zero second, the processor unit 38 may set a current event to "RUN SEQ-ON." For example, a start-sequence indicator 608 indicates to the operator that the remote test sequence unit 10 has started a sequence of operations using the fire extinguisher monitoring system 6. The start-sequence indicator 608 may be, for example, a red light or LED that would turn on at this juncture. From this step forward, as shown by Detector no. 1 LED column 710 and Detector no. 2 LED column 712, Detector no. 1 status 602 and Detector no. 2 status 604 may turn on and off intermittently to indicate that concentration data are being acquired. In one embodiment, Detector no. 1 column 710 and Detector no. 2 column 712 are each a green light or LED that would blink (turn off/on intermittently) every 30 seconds from start (second 0) to end of data recording sequence (second 270). At second 24, the current event may be set to "RUN SEQ-OFF" and start-sequence indicator 608 may be set to an off state.

Referring to step 504 of FIG. 12, the remote test sequence unit 10 may set a standby indicator 610 (as shown in FIG. 13) to a standby-on state until a first optimal testing time period has been reached. The standby indicator 610, in the standby-on state, indicates to the operator that the first optimal testing time period has not been reached. For example, the standby indicator 610 may be an amber light or LED. As shown in the event column 706 at second 30 in FIG. 14, the "PUMP-ON" event may be set to an on state.

From second 60 to second 144 of column 702 of FIG. 14, the following steps 506 and 508 as shown in FIG. 12 are performed. Referring to step 506 of FIG. 12, an airflow at an altitude of a flight operation may be automatically drawn through each of the plurality of detectors. Referring to step 508 of FIG. 12, for example, as the airflow is being drawn, the previous readings of each of the plurality of detectors are tared out similar to the process disclosed above with respect to FIGS. 8A and 8B.

Referring to step 510 of FIG. 12, once the previous readings are tared out and the flight conditions are achieved for performing the test, a processor coupled to the remote test sequence unit 10 determines that the first optimal testing time period has been reached. In one embodiment, the processor may be the processor unit 38 disclosed above. For example, as shown in second 150 of the first column 702 of FIG. 14, the current event may be set to "FIRE BOTTLE WINDOW—START" indicating that the first optimal testing time period has been reached for discharging or firing a bottle containing the fire suppression agent positioned for example, within the agent delivery unit 60. The remote test sequence unit 10 may set the discharge-readiness indicator 612 (denoted by "FIRE" in FIG. 13) to a discharge-on state. For example, once the discharge-readiness indicator 612 is set to the discharge-on state, the operator may activate the agent delivery unit 60 to pierce a seal of the fire bottle for an immediate release of a fire suppression agent to aircraft engine bays, engine nacelles, cargo compartments, and auxiliary power units that can be a source of fire in an aircraft. In another embodiment, delivery of the fire suppression agent may be performed using similar steps disclosed above with respect to FIGS. 1-10.

Referring to step 512 of FIG. 12, in one embodiment, the portable electronic device 40 generates concentration data using the data acquisition software. The concentration data may correspond to a plurality of concentration amounts at the plurality of detection locations 62, respectively, over a time period. Referring to step 514, the generated concentration data may be monitored in substantially real time to determine whether each of the plurality of concentration amounts at each of the plurality of detection locations 62, respectively, is maintained at a minimum concentration amount (for example, 6% for Halon 1301 and 17.6% for HFC-125) for at least a minimum time period of e.g., 0.5 sec.

Referring to step 516 of FIG. 12, the remote test sequence unit 10 may set the discharge-readiness indicator 612 (denoted by "FIRE" in FIG. 13) to a discharge-off state and the standby indicator to the standby-on state when the first optimal testing period (or time window) has elapsed. For example, as shown in FIG. 14, the length of first optimal testing period may be predetermined and set to, for example, 54 seconds (204 sec.-150 sec.). As seen in FIG. 14, the operator may discharge the fire suppression agent between seconds 150 and 204.

The predetermined length of the first optimal testing period depends on the amount of time that the flight characteristics are achieved and stabilized for discharging the fire suppression agent and monitoring the concentration amounts. For example, it may be determined in advance that the tared out characteristics provide an accurate measurement for approximately a predetermined accurate testing time period (e.g., one minute) before the airflow characteristics change to the extent that significantly reduces the accuracy of testing. In such embodiments, the remote test sequence unit 10 may be configured to determine a first optimal testing time instance such that the first optimal testing time period starts at the first optimal testing time instance and ends after a predetermined accurate testing time period has elapsed at which time the remote test sequence unit sets the discharge-readiness indicator to the discharge-off state and the standby indicator to the standby-on state.

In another embodiment, the length of the time period may be adjustable in substantially real time, for example, based on a determination of whether the airflow characteristics have remain stabilized for accurate testing since the time of taring out the airflow characteristics.

As disclosed in step 518 of FIG. 12, an advantageous feature of the present invention is that a flight operation or subsequent discharges of the fire suppression agent may be adjusted based on the concentration data monitored in substantially real time. For example, if in an extended testing period (several hours), it is determined that the plurality of concentration amounts remain below the minimum concentration amount (for example, 3% for Halon 1301 in a cargo test), it may be desirable to terminate the flight operation and testing at an earlier time for considerable savings in cost and flight time. Direct monitoring of the plurality of concentration amounts in substantially real time further allows adjustment of subsequent testing in other respects. Direct monitoring may be utilized, for example, as disclosed above with respect to FIG. 9.

As shown in FIG. 14, at second 270, the event is set to "RUN SEQ-OFF," the 270-seconds (4.5 minutes) sequence ends, and the remote test sequence unit 10 may be turned off manually (using the box power switch 614) or automatically.

It can be appreciated that the timing disclosed above with respect to FIGS. 12-14 can be customized to synchronize with flight operations.

Referring to step 520 of FIG. 12, once the first sequence of operations is completed, further testing may be desired because (a) the operator may not have discharged the fire suppression agent during the first optimal time period (for example, due to safety concerns) or (b) further testing may be desirable at a later time during the same flight (for example, at a different altitude). As such, after the first sequence of events from second 0 to 270 in FIG. 14 is completed, when the remote test sequence unit 10 receives a subsequent start-sequence input, the first sequence of operations may be repeated to determine a second optimal testing time period.

As such, the remote test sequence unit 10 allows for determining optimal testing time periods during a flight operation of an aircraft to discharge a fire suppression agent and accurately monitor its concentration amount at each of a plurality of detection locations 62 in the aircraft.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A calibration and dynamic flow control system connected to a processor for calibrating a fire extinguisher monitoring system and dynamically controlling flow in a closed-loop flow unit, the calibration and dynamic flow control system comprising:

a pneumatic unit configured to be fluidly connected to a first calibration container having a first mixture of at least a fire suppression agent with a first concentration amount and an airflow-simulating fluid for simulating airflow during a flight operation, and a closed-loop container configured to receive the first mixture from the first calibration container using the pneumatic unit, wherein the closed-loop flow unit includes the first closed-loop container and fluidly connects the first closed-loop container to each of a plurality of detection locations using at least one of a plurality of channels, the plurality of detection locations being monitored by a plurality of detectors, respectively;

a mixing fan configured to maintain a homogenous flow within the closed-loop flow unit;

an electrical control unit configured to electronically control operations of the calibration and dynamic flow control system; and a utility unit configured to control flow of mixtures in the closed-loop flow unit, wherein the processor is configured to tare out previous readings of the plurality of detectors to set a measurement baseline for each of the plurality of detectors, and the utility unit is further configured to draw the first mixture from the first calibration container through each of the plurality of detection locations when or after the processor sets the measurement baseline.

2. The calibration and dynamic flow control system of claim 1, wherein the closed-loop container is an inflatable bag, and the pneumatic unit is configured to be connected to a plurality of calibration containers, each of the plurality of calibration containers having a unique concentration amount of the fire suppression agent within a predetermined range of concentration amounts and connected via one of a plurality of valves to the pneumatic unit, the calibration and dynamic flow control system further configured to (a) purge contents of the inflatable bag;

(b) open a first valve connected to the first calibration container and close each of the other plurality of valves;

(c) draw, using the pneumatic unit, the first mixture from the first calibration container to the inflatable bag;

(d) draw, using a vacuum source, the first mixture in the inflatable bag through each of the plurality of detection locations; and (e) generate, using the processor, concentration data indicating concentration amounts of the fire suppression agent at each of the plurality of detection locations, wherein the concentration data are capable of being monitored in substantially real time.

3. The calibration and dynamic flow control system of claim 2 further configured to perform steps (a)-(e) of claim 2 for each calibration container of the plurality of calibration containers in order to generate, using the processor, cumulative concentration data indicating a concentration amount of the fire suppression agent at each of the plurality of detection locations for the predetermined range of concentration amounts over a time period.

4. The calibration and dynamic flow control system of claim 1 wherein the closed-loop container is an inflatable bag that inflates when the first mixture is drawn from the first calibration container into the inflatable bag and deflates when the first mixture is drawn from the inflatable bag through the plurality of detection locations, and the processor is configured to tare out previous readings of each of the plurality of detectors and generate a discharge-readiness signal when the previous readings are tared out, thereby indicating readiness for accurately monitoring a discharge of the fire suppression agent in substantially real time.

5. The calibration and dynamic flow control system of claim 1 wherein a vacuum source is configured to draw an ambient airflow through each of the plurality of detectors, and the processor is further configured to tare out an effect of the ambient airflow on an output of each of the plurality of detectors to set the measurement baseline.

6. A remote test sequence unit for coordinating operations of a fire extinguisher monitoring system with a flight operation of an aircraft to determine a first optimal testing time period for discharging a fire suppression agent, the remote test sequence unit configured to receive a first start-sequence input during the flight operation for starting a first sequence of operations of the remote test sequence unit and the fire extinguisher monitoring system; and perform the first sequence of operations when the first start-sequence input is received, including automatically setting a standby indicator to a standby-on state until the first optimal testing time period has been reached, automatically drawing an airflow at an altitude of the flight operation through each of the plurality of detectors, automatically taring out, using a processor, previous readings of each of the plurality of detectors to determine a measurement baseline for each of the plurality of detectors, and automatically setting the standby indicator to a standby-off state and a discharge-readiness indicator to a discharge-on state when the first optimal testing time period has been reached, wherein the processor is configured to generate concentration data in substantially real time corresponding to a plurality of concentration amounts of the fire suppression agent at a plurality of detection locations in the aircraft, respectively, over a time period.

7. The remote test sequence unit of claim 6, wherein the remote test sequence unit is further configured to re-perform the first sequence of operations when the remote test sequence unit receives a second start-sequence input during the flight operation.

8. The remote test sequence unit of claim 6, further configured to automatically set the standby indicator to the standby-off state when the first optimal testing time period has passed; and re-perform the first sequence of operations when the remote test sequence unit receives a second start-sequence input during the flight operation and the processor determines that either the fire suppression agent has not been discharged during the first optimal testing time period or a subsequent discharge of the fire suppression agent is requested.

9. The remote test sequence unit of claim 6, wherein the remote test sequence unit is further configured to determine a first optimal testing time instance, and the first optimal testing time period starts at the first optimal testing time instance and ends after a predetermined accurate testing time period has elapsed, the remote test sequence unit further configured to set the discharge-readiness indicator to a discharge-off state and the standby indicator to the standby-on state when the predetermined accurate testing time period elapses.

10. A method of calibrating and dynamically controlling a testing operation of a fire extinguisher monitoring system of an aircraft, the method comprising:

drawing an ambient airflow through each of a plurality of detectors;

providing a processor for taring out ambient airflow characteristics to determine a measurement baseline for each of the plurality of detectors;

providing a closed-loop flow unit that includes a first closed-loop container with a known volume and fluidly connected to a plurality of detection locations using a plurality of channels, the plurality of detection locations being monitored by a plurality of detectors, respectively;

providing a first calibration container having a first mixture of at least a fire suppression agent with a first concentration amount and an airflow-simulating fluid for simulating an on-flight airflow, the first calibration container configured to be fluidly connected to the closed-loop flow unit via a pneumatic unit;

directing, using the pneumatic unit, the first mixture from the first calibration container into the closed-loop container;

simulating, using the closed-loop flow unit, an on-flight discharge of the fire suppression agent by drawing, using a vacuum source, the first mixture in the closed-loop container through each of the plurality of detection locations;

generating, using the processor, concentration data in substantially real time, the concentration data indicating a concentration amount of the fire suppression agent at each of the plurality of detection locations over a first time period; and adjusting a flow of the fire suppression agent within the closed-loop flow unit based on the concentration data.

11. The method of claim 10, wherein the step of adjusting the concentration amount and flow of the fire suppression agent within the closed-loop flow unit includes:

monitoring the generated concentration data in substantially real time to determine whether a minimum concentration amount of the fire suppression agent is maintained for at least a predetermined minimum time period at each of the plurality of detection locations, and adjusting distribution of the first mixture or a second mixture with a second concentration amount of the fire suppression agent in the closed-loop flow unit based on the monitored concentration data.

12. The method of claim 10, further comprising:

calibrating the fire extinguisher monitoring system and dynamically controlling fluid flow in the closed-loop flow unit over a predetermined range of concentration amounts of the fire suppression agent by providing a plurality of calibration containers, each containing one of a plurality of mixtures, each mixture having a unique concentration amount of the fire suppression agent within the predetermined range of concentration amounts, sequentially drawing, using the pneumatic unit, each of the plurality of mixtures through the plurality of detection locations, generating, using the processor, concentration data indicating concentration amounts of the fire suppression agent at each of the plurality of detection locations for the predetermined range of concentration amounts of the fire suppression agent, and determining, based on the generated concentration data, whether each of a plurality of concentration amounts of the fire suppression agent at the plurality of detection locations, respectively, is maintained at or greater than the minimum concentration amount for at least a predetermined minimum time period for the predetermined range of concentration amounts.

13. The method of claim 10, further comprising:

purging contents of the first calibration container and measuring a weight of the first calibration container;

measuring a weight of the first calibration container containing the fire suppression agent; and determining a weight of the fire suppression agent based on the measured weight of the first calibration container and the measured weight of the first calibration container containing the fire suppression agent.

14. The method of claim 13, further comprising:

determining a weight of the airflow-simulating fluid based on a desired concentration level of the fire suppression agent;

measuring a weight of the first calibration container containing the fire suppression agent and the airflow-simulating fluid;

determining a weight of the airflow-simulating fluid in the first container based on the measured weight of the fire suppression agent and the measured weight of the first calibration container containing the fire suppression agent and the airflow-simulating fluid; and determining the first concentration amount of the fire suppression agent in the first calibration container based on the measured weight of the fire suppression agent and the measured weight of the airflow-simulating fluid.

15. The method of claim 10, further comprising:

taring out, using the processor, previous readings of each of the plurality of detectors, wherein the step of simulating the discharge of the fire suppression agent is performed after the previous readings are tared out.

16. The method of claim 10, further comprising:

modifying distribution of the fire suppression agent through at least one of the plurality of detectors based on direct monitoring of the concentration data.

17. The method of claim 10, further comprising:

providing a remote test sequence unit for coordinating operations of the fire extinguisher monitoring system with a flight operation of the aircraft to determine a first optimal testing time period for discharging a fire suppression agent;

receiving, using the remote test sequence unit, a first start-sequence input during the flight operation for starting a first sequence of operations of the remote test sequence unit and the fire extinguisher monitoring system; and performing, using the remote test sequence unit, the first sequence of operations when the start-sequence input is received, including automatically setting a standby indicator to a standby-on state until the optimal time for testing has been reached, automatically drawing, using the fire extinguisher monitoring system, an airflow at an altitude of the flight operation through each of the plurality of detectors, automatically taring out, using the processor, previous readings of each of the plurality of detectors to determine a measurement baseline for each of the plurality of detectors, and automatically setting, using the remote test sequence unit, the standby indicator to a standby-off state and a discharge-readiness indicator to a discharge-on state when the first optimal testing time period has been reached, wherein the processor in signal communication with the remote test sequence unit and configured to generate concentration data in substantially real time that indicate a concentration amount of the fire suppression agent at each of a plurality of detection locations in the aircraft over a second time period.

18. The method of claim 17, further comprising:

re-performing the first sequence of operations, using the remote test sequence unit, when the remote test sequence unit receives a second start-sequence input during the flight operation.

19. The method of claim 18, further comprising:

automatically setting, using the remote test sequence unit, the standby indicator to the standby-on state when the optimal time period has elapsed; and re-performing the first sequence of operations when the remote test sequence unit receives a second start-sequence input during the flight operation and the processor determines that either the fire suppression agent has not been discharged during the optimal time period or a subsequent discharge of the fire suppression agent is desired.

20. The method of claim 19, further comprising:

determining a first optimal testing time instance, wherein the first optimal testing time period starts at the first optimal testing time instance and ends after a predetermined accurate testing time period has elapsed at which time the remote test sequence unit sets the discharge-readiness indicator to a discharge-off state and the standby indicator to the standby-on state.

* * * * *